US010655071B2

(12) United States Patent
Iliyas et al.

(10) Patent No.: US 10,655,071 B2
(45) Date of Patent: May 19, 2020

(54) ETHYLENE FURNACE PROCESS AND SYSTEM

(71) Applicant: SABIC GLOBAL TECHNOLOGIES B.V., Bergen op Zoom (NL)

(72) Inventors: Abduljelil Iliyas, Riyadh (SA); Munawar Saudagar, Riyadh (SA); Hatem Belfadhel, Riyadh (SA)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 68 days.

(21) Appl. No.: 15/314,133

(22) PCT Filed: May 28, 2015

(86) PCT No.: PCT/IB2015/001586
§ 371 (c)(1),
(2) Date: Nov. 28, 2016

(87) PCT Pub. No.: WO2015/181638
PCT Pub. Date: Dec. 3, 2015

(65) Prior Publication Data

US 2017/0101586 A1 Apr. 13, 2017

Related U.S. Application Data

(60) Provisional application No. 62/003,994, filed on May 28, 2014.

(51) Int. Cl.

| | |
|---|---|
| ***C10G 9/16*** | (2006.01) |
| ***C10G 75/00*** | (2006.01) |
| ***F27B 19/04*** | (2006.01) |
| ***C10G 9/36*** | (2006.01) |
| ***C10G 9/20*** | (2006.01) |

(52) U.S. Cl.
CPC ..... *C10G 9/16* (2013.01); *C10G 9/206* (2013.01); *C10G 9/36* (2013.01); *C10G 75/00* (2013.01);
(Continued)

(58) Field of Classification Search
CPC ..... C10G 9/16; C10G 9/206; C10G 75/00; C10G 9/36; C10G 2300/4075; F27B 19/04
See application file for complete search history.

(56) References Cited

U.S. PATENT DOCUMENTS 5,446,229 A * 8/1995 Taylor ..... C10G 9/16 208/132
5,733,438 A * 3/1998 Tong ..... C10G 9/16 208/48 R (Continued)

OTHER PUBLICATIONS

Cai et al., "Coke formation in steam crackers for ethylene production", Chemical Engineering and Processing 41 (2002) 199-214.*

(Continued)

*Primary Examiner* — Ali Z Fadhel
(74) *Attorney, Agent, or Firm* — Norton Rose Fulbright US LLP

(57) ABSTRACT

Methods and systems for managing a decomposition process are disclosed. An example method can comprise estimating a coking rate for a process based on a coking model. The coking model can comprise a pyrolytic coking term and a catalytic coking term. An example method can comprise, performing at least a portion of the process, receiving a parameter for the process, and adjusting an operation of the process based on the parameter.

13 Claims, 16 Drawing Sheets

(52) U.S. Cl.
CPC ..... *F27B 19/04* (2013.01); *C10G 2300/4075* (2013.01)

(56) References Cited

U.S. PATENT DOCUMENTS

| | | | | |
|---|---|---|---|---|
| 5,774,381 | A | 6/1998 | Meier | 364/578 |
| 2002/0123864 | A1* | 9/2002 | Eryurek | G05B 23/0254 702/188 |

OTHER PUBLICATIONS

Sadrameli, "Thermal/catalytic cracking of hydrocarbons for the production of olefins: A state-of-the-art review I: Thermal cracking review", Fuel 140 (2015) 102-115.*

Albright et al., "Mechanistic Model for Formation of Coke in Pyrolysis Units Producing Ethylene", Ind. Eng. Chem. Res. 1988,27, 755-759.*

Reyniers et al., "Influence of Metal Surface and Sulfur Addition on Coke Deposition in the Thermal Cracking of Hydrocarbons", Ind. Eng. Chem. Res. 1995, 34, 773-785. (Year: 1995).*

International Search Report and Written Opinion for PCT/IB2015/001586 dated Nov. 13, 2015.

Ramirez Hernandez, A. Y. "A Model for the Prediction of Olefin Production and Coke Deposition During Thermal Cracking of Light Hydrocarbons." (Master's Thesis, Universidad Nacional de Colombia, 2012), 1-39.

Ramirez Hernandez, A.Y. "A Model for the Prediction of Coke Depositions During Thermal Cracking of Ethane/Propane Mixtures." Paper presented at the 2010 AIChE Annual Meeting at Salt Lake City, Utah. Nov. 7-12, 2010. [Accessed Oct. 18, 2013].

Towfighi, J. et al. "Estimation of Kinetic Parameters of Coking Reaction Rate in Pyrolysis of Naptha." *International Journal of Engineering Transactions B: Applications*. 17(4): 2004, pp. 319-332.

Xiao, Jiazhi et al. "Study on Correlative Methods for Describing Cooking Rate in Furnace Tubes." *Petroleum Science and Technology*. 18(3-4): 2000, pp. 305-318.

* cited by examiner

| Model parameters | | Optimal Estimate | Confidence Intervals | | | 95% t-value | Standard Deviation |
|---|---|---|---|---|---|---|---|
| | | | 90% | 95% | 99% | | |
| Roughness parameter of coil | $\alpha$ | 2.4832 | Value fixed by user | | | | |
| Coke thermal conductivity parameter for temperature dependence | $\beta_{coke}$ | 0.00 | Value fixed by user | | | | |
| Effective thermal conductivity of coke layer at Tref | $\lambda_{coke}^{ref}$ | 5.00 | Value fixed by user | | | | |
| Activation energy for pyrolytic coking | $E_c$ | 200000.00 | Value fixed by user | | | | |
| Activation energy for catalytic coking | $E_{cat}$ | 200000.00 | Value fixed by user | | | | |
| htc adjustment | $htc_{adj}$ | 1.00 | Value fixed by user | | | | |
| log10 (Rate constant for pyrolytic coking at Tref) | $log10(k_c^{ref})$ | -4.2068 | 0.0479 | 0.0571 | 0.0754 | 73.6472 | 0.0289 |
| log10 (Rate constant for catalytic coking at Tref) | $log10(k_{cat}^{ref})$ | -3.2615 | 0.0920 | 0.1098 | 0.1450 | 29.6986 | 0.0556 |
| log10 (Rate constant for pyrolytic coking at Tref / Maximum surface concentration of catalyst) | $log10\left(\frac{k_c^{ref}}{C_{cat}^{max}}\right)$ | -7.0266 | 0.1250 | 0.1492 | 0.1971 | 47.0832 | 0.0755 |
| Initial thickness coke layer | | 1.00E-06 | Value fixed by user | | | | |
| Wall thermal conductivity parameter for temperature dependence | $\beta_{wall}$ | 0.0159 | Value fixed by user | | | | |
| Effective thermal conductivity of wall at Tref | $\lambda_{wall}^{ref}$ | 24.0680 | Value fixed by user | | | | |
| | | | | | | | |
| | | | | Reference t-value (95%): | | 1.6558 | |

FIG. 8A

| Parameter | Parameter Number | 1 | 2 | 3 |
|---|---|---|---|---|
| $log10(k_c^{ref})$ | 1 | 1.00 | | |
| $log10(k_{cat}^{ref})$ | 2 | 0.52 | 1.00 | |
| $log10\left(\frac{k_c^{ref}}{C_{cat}^{max}}\right)$ | 3 | 0.72 | 0.86 | 1.00 |

FIG. 8B

| Model parameters | | Optimal Estimate | Confidence Intervals | | | 95% t-value | Standard Deviation |
|---|---|---|---|---|---|---|---|
| | | | 90% | 95% | 99% | | |
| Roughness parameter of coil | $\alpha$ | 2.4832 | Value fixed by user | | | | |
| Coke thermal conductivity parameter for temperature dependence | $\beta_{coke}$ | 0.0 | Value fixed by user | | | | |
| Effective thermal conductivity of coke layer at Tref | $\lambda_{coke}^{ref}$ | 5.0 | Value fixed by user | | | | |
| Activation energy for pyrolytic coking | $E_c$ | 200000.0 | Value fixed by user | | | | |
| Activation energy for catalytic coking | $E_{cat}$ | 200000.0 | Value fixed by user | | | | |
| htc adjustment | $htc_{adj}$ | 1.0 | Value fixed by user | | | | |
| log10 (Rate constant for pyrolytic coking at Tref) | $log10(k_c^{ref})$ | -4.9370 | 0.0800 | 0.0955 | 0.1259 | 51.6810 | 0.0485 |
| log10 (Rate constant for catalytic coking at Tref) | $log10(k_{cat}^{ref})$ | -3.9296 | 0.1009 | 0.1204 | 0.1587 | 32.6331 | 0.0611 |
| log10 (Rate constant for pyrolytic coking at Tref / Maximum surface concentration of catalyst) | $log10\left(\frac{k_c^{ref}}{C_{cat}^{max}}\right)$ | -7.6596 | 0.1467 | 0.1750 | 0.2307 | 43.7591 | 0.0888 |
| Initial thickness coke layer | | 1.0E-06 | Value fixed by user | | | | |
| Wall thermal conductivity parameter for temperature dependence | $\beta_{wall}$ | 0.0159 | Value fixed by user | | | | |
| Effective thermal conductivity of wall at Tref | $\lambda_{wall}^{ref}$ | 24.0680 | Value fixed by user | | | | |
| | | | | | | | |
| | | | | Reference t-value (95%): | | 1.6509 | |

FIG. 12A

| Parameter | Parameter Number | 1 | 2 | 3 |
|---|---|---|---|---|
| $log10(k_c^{ref})$ | 1 | 1.00 | | |
| $log10(k_{cat}^{ref})$ | 2 | 0.63 | 1.00 | |
| $log10\left(\frac{k_c^{ref}}{C_{cat}^{max}}\right)$ | 3 | 0.81 | 0.96 | 1.00 |

FIG. 12B

ETHYLENE FURNACE PROCESS AND SYSTEM

CROSS-REFERENCE TO RELATED APPLICATIONS

This application is a national phase application under 35 U.S.C. § 371 of International Application No. PCT/IB2015/001586 filed 28 May 2015, which claims priority to U.S. Provisional Patent Application No. 62/003,994 filed 28 May 2014. The entire contents of each of the above-referenced disclosures is specifically incorporated by reference herein without disclaimer.

SUMMARY

It is to be understood that both the following general description and the following detailed description are exemplary and explanatory only and are not restrictive, as claimed. Provided are methods and systems for managing a decomposition process. An example method can comprise estimating a coking rate for a process based on a coking model. The coking model can comprise a pyrolytic coking term and a catalytic coking term. An example method can comprise performing at least a portion of the process, receiving a parameter for the process, and adjusting an operation of the process based on the parameter.

In another aspect, an example method can comprise determining a first coking rate for a process based on a coking model. The coking model can comprise a pyrolytic coking term and a catalytic coking term. An example method can comprise determining a second coking rate of the process, and adjusting a process based on a comparison of the first coking rate and the second coking rate.

In one aspect, an example method can comprise determining, based on a coking model, an effect of an operation on a coking rate of a first process. The coking model can comprise a pyrolytic coking term and a catalytic coking term. An example method can comprise estimating an effect of the operation on a second process. The estimation can be based on the coking model and the effect of the operation on the coking rate of the first process.

In another aspect, an example method can comprise determining a first coking rate of a process and applying an operation to the process after the first coking rate is determined. An example method can comprise determining, based on a coking model, a second coking rate of the process. The second coking rate can be indicative of the operation. The coking model can comprise a catalytic coking term and a pyrolytic coking term. An example method can comprise comparing the first coking rate to the second coking rate and evaluating the operation based on the comparison of the first coking rate to the second coking rate.

Additional advantages will be set forth in part in the description which follows or may be learned by practice. The advantages will be realized and attained by means of the elements and combinations particularly pointed out in the appended claims.

BRIEF DESCRIPTION OF THE DRAWINGS

The accompanying drawings, which are incorporated in and constitute a part of this specification, illustrate embodiments and together with the description, serve to explain the principles of the methods and systems:

FIG. 8A shows example parameters for an example coking model;

FIG. 8B shows a correlation matrix of parameters for the coking model;

FIG. 12A shows example parameters for an example coking model for an ethylene furnace after an anti-coking procedure is applied;

FIG. 12B shows a correlation matrix of parameters for the coking model;

DETAILED DESCRIPTION

Figure 1:
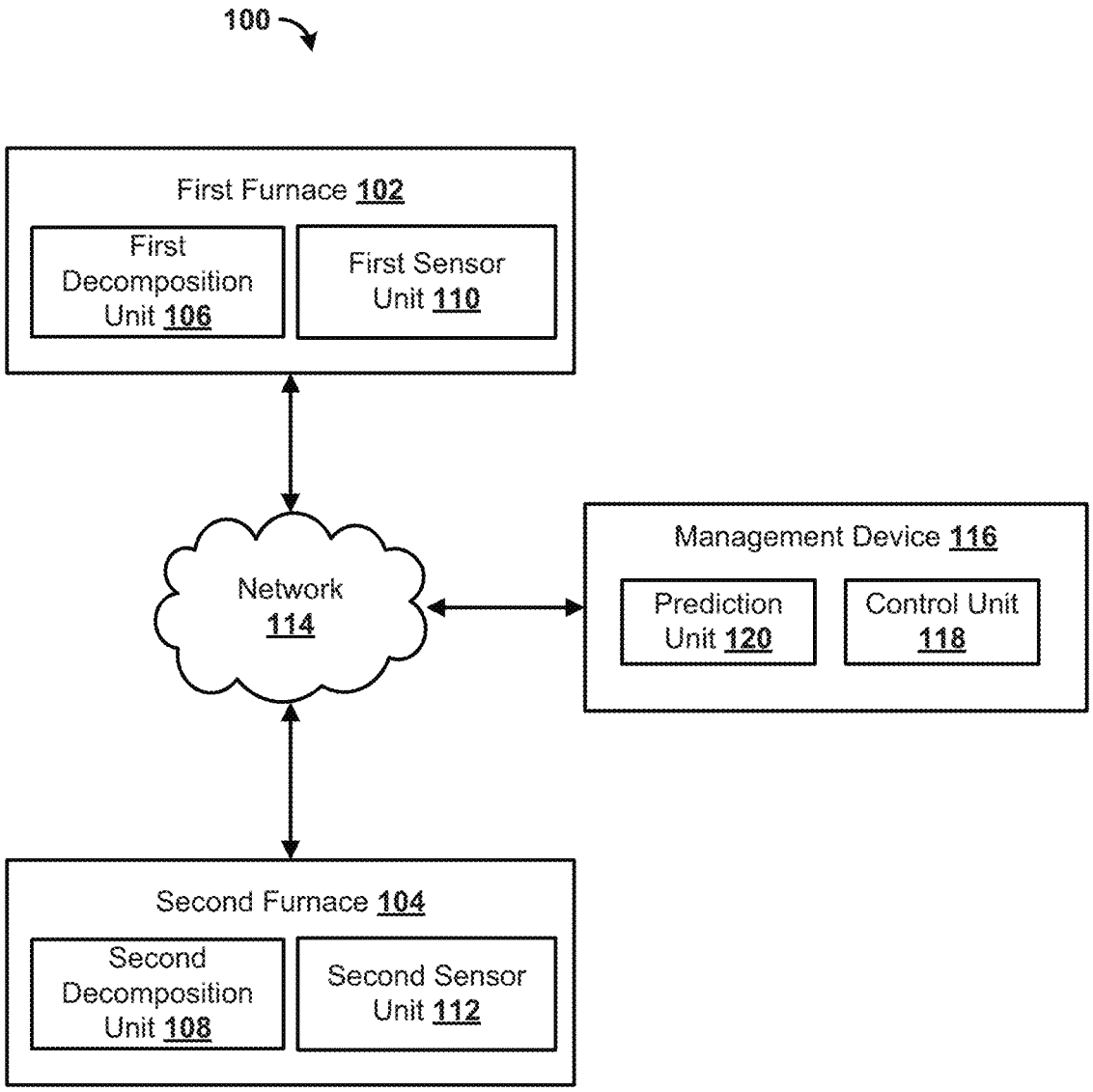
FIG. 1 is a block diagram illustrating an exemplary system for managing a process.

Before the present methods and systems are disclosed and described, it is to be understood that the methods and systems are not limited to specific methods, specific components, or to particular implementations. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and systems may be understood more readily by reference to the following detailed description of preferred embodiments and the examples included therein and to the Figures and their previous and following description.

As will be appreciated by one skilled in the art, the methods and systems may take the form of an entirely hardware embodiment, an entirely software embodiment, or an embodiment combining software and hardware aspects. Furthermore, the methods and systems may take the form of a computer program product on a computer-readable storage medium having computer-readable program instructions (e.g., computer software) embodied in the storage medium. More particularly, the present methods and systems may take the form of web-implemented computer software. Any suitable computer-readable storage medium may be utilized including hard disks, CD-ROMs, optical storage devices, or magnetic storage devices.

Embodiments of the methods and systems are described below with reference to block diagrams and flowchart illustrations of methods, systems, apparatuses and computer program products. It will be understood that each block of the block diagrams and flowchart illustrations, and combinations of blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create a means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including computer-readable instructions for implementing the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions.

The present disclosure relates to methods and systems for managing a decomposition process. For example, the decomposition process can comprise the decomposition (e.g., cracking, breakdown) of complex hydrocarbons (e.g., ethane) into simpler hydrocarbons (e.g., ethylene). In one aspect, the decomposition process can result in the production of coke. Coke can form on the inside of a furnace used for the decomposition process. For example, the furnace can comprise pipes that are used to pass the hydrocarbons through the furnace. The gradual formation of coke can increase pressure and temperature of the pipes. Procedures can be used to remove the coke from a furnace and/or to slow the formation of coke. Often, there is no trustworthy data indicating how a particular anti-coking procedure will affect the formation of coke. A coking model can be used to predict the formation of coke. The coking model can account for coke formation due to both pyrolytic processes and catalytic process. For example, the coking model can comprise a first term due to pyrolytic coke formation and a second term due to catalytic coke formation. The coking model can be used to predict the formation of coke after an anti-coking procedure is applied to a furnace. The actual coking rate can be compared to the coking rate predicted by the coking model. Then, predictions can be made, using the coking model, as to the coking rate of a different furnace to which the same or similar anti-coking procedure is applied.

FIG. 1 is a block diagram illustrating an exemplary system 100 for managing a process. Those skilled in the art will appreciate that present methods may be used in systems that employ both digital and analog equipment. One skilled in the art will appreciate that provided herein is a functional description and that the respective functions can be performed by software, hardware, or a combination of software and hardware.

In one aspect, the system 100 can comprise one or more furnaces. For example, the system 100 can comprise a first furnace 102 and a second furnace 104. The first furnace 102 can comprise a first decomposition unit 106 configured to cause a decomposition process on a material. The second furnace 104 can comprise a second decomposition unit 108 configured to cause a decomposition process on a material. For example, the first decomposition unit 106 and/or second decomposition unit 108 can be configured to cause the decomposition, break down, cracking, and/or the like of a compound into a less complex compound and/or element. As an example, the first decomposition unit 106 and/or second decomposition unit 108 can be configured to cause decomposition, break down, cracking, and/or the like from complex hydrocarbons (e.g., ethane, propane, butane, naphtha, gas oil) or other materials into simpler compounds (e.g., ethylene, propene, hydrogen, methane, butene, fuel oil).

In one aspect, the first decomposition unit 106 and/or second decomposition unit 108 can be configured to cause decomposition by use of thermal cracking, steam cracking, catalytic cracking, and/or the like. For example, the first decomposition unit 106 and/or second decomposition unit 108 can comprise various components, such as burners, tubes, valves, joints, boilers, motors, pumps, condensers, reactors, and/or the like, configured to generate, isolate, condition, and/or otherwise process materials (e.g., elements, compounds) by use of a decomposition process. As an example, steam cracking can comprise mixing a hydrocarbon gas with steam. The hydrocarbon gas mixed with steam can be passed through tubes that are heated (e.g., to a temperature above 1000 K) in a furnace, thereby causing decomposition of the hydrocarbons.

As an illustration, the first furnace 102 and/or second furnace 104 can be configured to perform a cracking reaction. For example, thermal and/or catalytic cracking of hydrocarbons mixtures can be performed to produce more valuable hydrocarbon products. As a further example, a cracking reaction can comprise thermal cracking of ethane diluted with steam to produce ethylene at temperature between 800-900° C. and pressure between 1-3 bar. The first furnace 102 and/or second furnace 104, for example, can have additional process to prevent coke formation that would typically limit its run-time. This additional process can comprise, for example, passivation of tube internals by inert materials (e.g., anti-coking materials), by gasification of the coke to other gaseous products, and/or the like.

In one aspect, the first furnace 102 and/or second furnace 104 can comprise one or more sensors. For example, the first furnace 102 can comprise a first sensor unit 110. The second furnace 104 can comprise a second sensor unit 112. The first sensor unit 110 and/or second sensor unit 112 can comprise one or more sensors configured to determine one or more parameters associated with the first furnace 102 and/or second furnace 104. For example, example parameters can comprise temperatures, pressures, amount and/or presence of a compound or element, and/or the like. As a further example, the first sensor unit 110 can be configured to determine parameters associated with the first furnace 102, such as coil output temperature, tube metal temperature, pressure drop through a tube, and/or the like. The second sensor unit 112 can be configured to determine parameters associated with the second furnace 104, such as coil output temperature, tube metal temperature, pressure drop through a tube, and/or the like.

The first furnace 102 and/or second furnace 104 can be operated and/or controlled manually or by a computing device. The components of the first decomposition unit 106 and/or second decomposition unit 108 can be operated and controlled manually (e.g., by valves, levers, switches, and/or the like), by a local computer, by a remote computer, and/or the like. For example, the first decomposition unit 106 and/or second decomposition unit 108 can be communicatively coupled to a local and/or remote computing device through a local bus and/or a network 114. Additionally, the first sensor unit 110 and/or second sensor unit 112 can be configured to provide sensor data to a local or remote computing device through the network 114.

In one aspect, the network 114 can comprise a packet switched network (e.g., internet protocol based network), a non-packet switched network (e.g., modulation based network), and/or the like. The network 114 can comprise network adapters, switches, routers, modems, and the like connected through wireless links (e.g., radio frequency, satellite) and/or physical links (e.g., fiber optic cable, coaxial cable, Ethernet cable, or a combination thereof). In one aspect, the network 114 can be configured to provide communication from telephone, cellular, modem, and/or other electronic devices to and throughout the system 100.

In one aspect, the system 100 can comprise a management device 116 configured to manage one or more furnaces, such as the first furnace 102 and second furnace 104. It should be noted that, while only one management device is shown, it is contemplated that additional management devices can be used in various implementations. For example, an example system 100 can comprise a management device for each furnace (e.g., located onsite with the furnace).

In one aspect, the management device 116 can comprise a control unit 118. The control unit 118 can be configured to control the first furnace 102 and/or second furnace 104. For example, the control unit 118 can be configured to receive sensor data from the first furnace and/or second furnace 104. The control unit 118 can store the sensor data, provide the sensor data to a user, and/or otherwise process the sensor data. For example, the control unit 118 can provide a notification, such as warning based on a comparison of the sensor data to a threshold. In another aspect, the control unit 118 can be configured to generate a signal, message, and/or the like configured to control operation of the first furnace 102 and/or second furnace. For example the control unit 118 can provide a command to the first furnace 102 and/or second furnace 104 or to a device associated therewith (e.g., terminal) to modify, update, adjust, and/or otherwise change a state of a furnace. For example the command can be automatically implemented by the furnace or manually be a technician. As an illustration, the command can be indicative of turning a valve (e.g., on or off), modifying a state of a switch or lever, altering a supply of a substance, changing a temperature, changing a pressure, and/or the like.

In one aspect, the management device 116 can comprise a prediction unit 120. In one aspect, the prediction unit 120 can be configured to predict future operations of the first furnace and/or second furnace. For example, the prediction unit 120 can comprise one or more models (e.g., computational model) configured to predict operational aspects of the first furnace 102 and/or second furnace 104. For example, the prediction unit 120 can be configured to predict operational parameters, such as temperature, pressure, amount of substance produced, furnace run time, and/or the like. As an example, operational parameters can comprise, coil output temperature, tube metal temperature, pressure drop through a tube, time to perform maintenance, production rate of a substance (e.g., ethylene) or byproduct thereof (e.g., coke).

In one aspect, the prediction unit 120 can be configured to predict operational parameters of the first furnace 102 and/or second furnace 104 based on the performance of a procedure (e.g., operation) modifying at least a portion of the operation of a furnace. As an example, the procedure can comprise an anti-coking procedure, such as replacing a component (e.g., tube) with a component configured to reduce and/or eliminate coking. The procedure can comprise coating a component with a layer configured to reduce and/or eliminate coking. The procedure can comprise adding a substance (e.g., chemical, agent, catalyst) to a feedstock, steam, or other insertion into a component of a component during operation of the furnace.

In one aspect, the prediction unit 120 can predict a coking rate (e.g., rate of generating coke) for a furnace based on a coking model. The coking model can comprise a pyrolytic term configured to predict a portion of the coking rate due to pyrolytic processes. For example, the pyrolytic term can be assumed as a first order reaction with respect to the coking agent. The coking model can comprise a catalytic term configured to predict a portion of the coking rate due to catalytic processes. The catalytic term can be assumed to be a first order reaction with respect to a decomposed hydrocarbon (e.g., ethylene), and the rate constant of the catalytic term can decrease with decreasing concentration of catalytically active site. The concentration of active sites can decrease due to pyrolytic coke blocking access to the catalytic surface.

An example coking rate can be defined for a coking model as follows:

$$r_{coking}(z)=k_c c_a^*(z)+k_{cat}\varphi_{cat}(z)c_{ethylene}(z),\ z\in[0,L] \tag{1}$$

where the first term on the right side of the equal sign is the contribution due to pyrolytic coking and the second term on the right side of the equal sign is the contribution due to catalytic coking. The concentration of the coking agent $c_a^*$ is the bulk gas concentration.

The surface concentration of catalytically active sites, $c_{cat}$ can change with time due to pyrolytic coke formation, as follows:

$$\frac{d\varphi_{cat}(z)}{dt} = -k_c c_a*(z)\varphi_{cat}(z),\ z\in[O,\ L] \tag{2}$$

$$\varphi_{cat}(z) = \left(\frac{c_{cat}}{c_{cat}^{max}}\right),\ k'_{cat} = \frac{k_c}{c_{cat}^{max}}$$

where $c_{cat}^{max}$ is the maximum surface concentration of catalytically active sites and with the initial condition:

$$\varphi_{cat}(z)=1,\ z\in[0,L],\ t=0 \tag{3}$$

The rate constant $k_c$ (e.g., and similarly $k_{cat}$) can have the Arrhenius dependence on temperature expressed in terms of the rate constant at reference temperature:

$$k_c = k_c^{ref}\exp\left(\frac{-E_c}{R}\left(\frac{1}{T}-\frac{1}{T_{ref}}\right)\right) \tag{4}$$

$$k_{cat} = k_{cat}^{ref}\exp\left(\frac{-E_{cat}}{R}\left(\frac{1}{T}-\frac{1}{T_{ref}}\right)\right) \tag{5}$$

For better parameter estimation, a modified rate constant, $k'_c$ can be introduced:

$$k'_c = \frac{k_c}{c_{cat}^{max}} = k_c^{ref\,\prime}\exp\left(\frac{-E_c}{R}\left(\frac{1}{T}-\frac{1}{T_{ref}}\right)\right) \tag{6}$$

where $$k_c^{ref\,\prime} = \frac{k_c^{ref}}{c_{cat}^{max}} \tag{7}$$

In one aspect, the prediction unit 120 can be configured to predict the coking rate of a furnace to which an anti-coking procedure is applied. For example, the prediction unit 120 can predict the coking rate of a furnace based on historical operating data of the furnace and/or history data of another furnace. As an illustration, historical operating data can be collected for the first furnace 102. The historical operating data can comprise operating data for operations before an anti-coking procedure is applied to the first furnace 102 and/or historical operating data for operations after the anti-coking procedure is applied. The historical operating data can comprise operating data for operations of the second furnace 104 before the anti-coking procedure is applied to the second furnace 104. The historical operating data of the first furnace 102 and/or second furnace can be used to predict coking rate of the second furnace 104 after the anti-coking procedure is applied to the second furnace 104. For example, the historical operating data can be used to determine input parameters for the coking model. The input parameters can be determined based the imprint (e.g., effects on measured quantities and parameters of a reaction) of the anti-coking technology, which can be distinctly separated from the first furnace 102 performance and captured via the coking model parameters explained in example equations above (e.g., equations 4-7). The captured imprints of the anti-coking performance from furnace 102 can superimposed with second furnace 104 base performance to predict expected performance improvement upon implementation of the anti-coking technology.

In one aspect, the prediction unit 120 can be configured to provide control parameters to the control unit 118. For example, the management device 116 can receive real-time operating information (e.g., tube metal temperature, pressure drop of tube, coil output temperature) from the first furnace 102 and/or second furnace 104. The control unit 118 can be configured to request and/or receive a prediction related to the formation of coke in the second furnace 104 from the prediction unit 120. In one aspect, the second furnace 104 can modify an operating parameter of the second furnace 104 in real-time in response to the prediction. For example, the control unit 118 can receive an updated coking rate based on a coking model. The control unit 118 can determine, update, and/or modify in real-time one or more operating parameters of the second furnace 104, such as a time to schedule maintenance, a time to end a particular run cycle of the furnace, an amount of energy to supply to the furnace, an amount of material (e.g., complex hydrocarbon, steam) to provide to the furnace, and/or the like.

Figure 2:
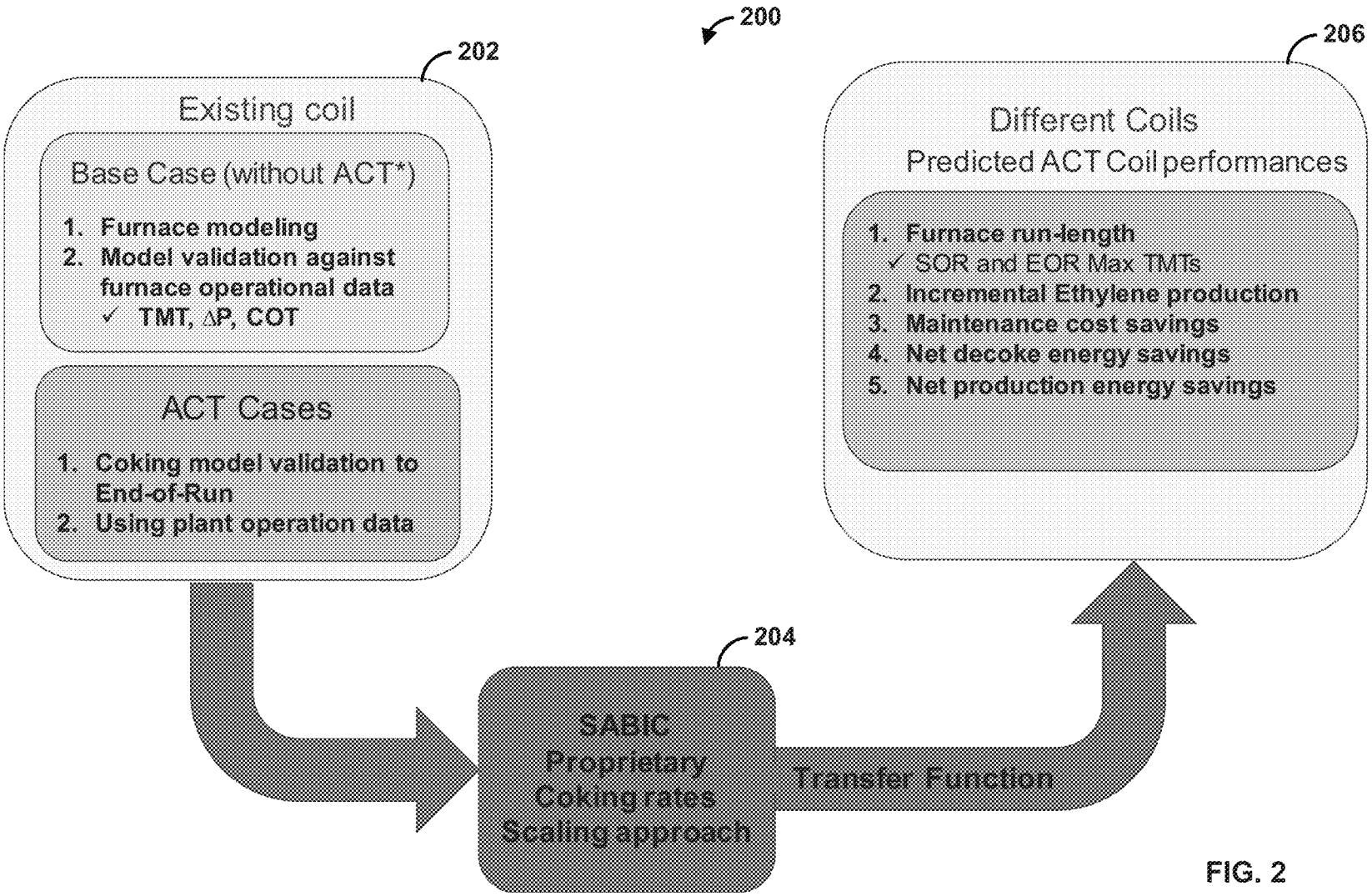
FIG. 2 is a flowchart illustrating an example process for managing a decomposition process.

FIG. 2 is a flowchart illustrating an example process 200 for managing a decomposition process. At step 202, coking rates can be predicted based on a coking model. For example, the coking model can be used to predict coking rates on an existing device (e.g., coil, furnace, tube). The coking model can be used to predict coking rates when an anti-coking technology (e.g., procedure) is applied to the device and/or when an anti-coking technology is not applied to the device. The model can be validated against operational data of the device (e.g., furnace operational data).

At step 204, the coking model can be scaled to apply to other devices (e.g., coils, furnaces, tubes). For example, the coking model can be scaled by close coupling of the coke models with the process chemistry, thermodynamics, physical process models, and/or the like of the other furnaces. In other words, the coking model can be configured to receive input information. The input information can be independent (e.g., independent of scale) and specific to the characteristic performance of the other furnace to predicts the other devices expected performance.

At step 206, the coking model can be used for the other devices. For example, start of run time, end of run time, max tube metal temperature, and other parameters can be selected for the device based on the coking model.

Figure 3:
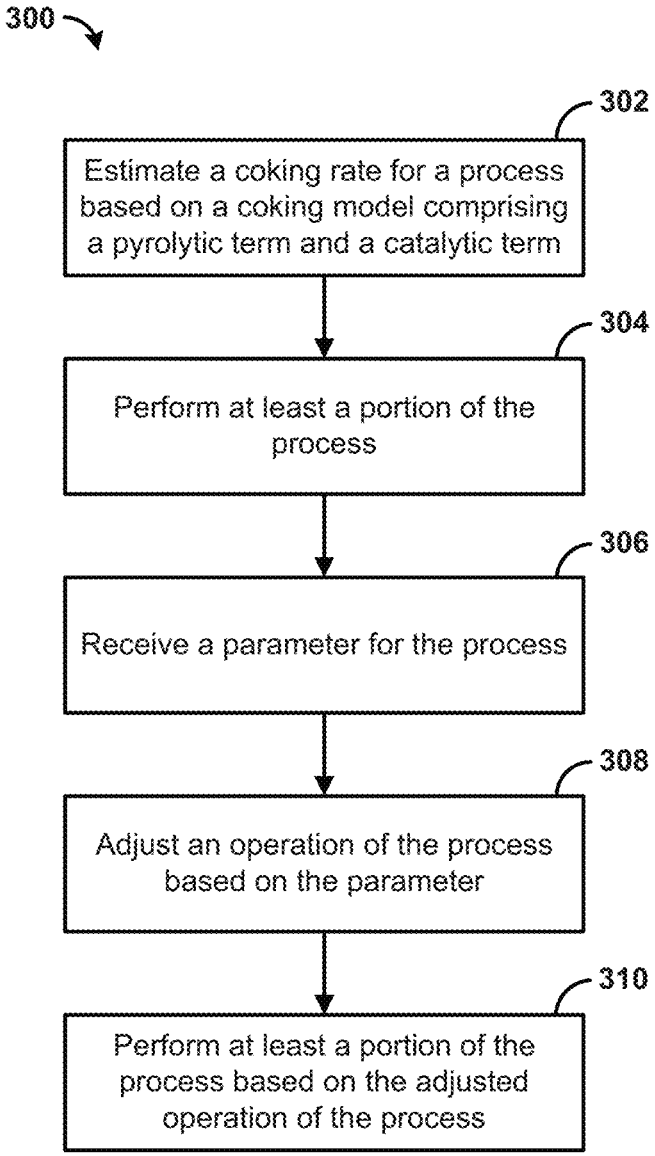
FIG. 3 is a flowchart illustrating an example method for managing a decomposition process.

FIG. 3 is a flowchart illustrating an example method 300 for managing a decomposition process. At step 302, a coking rate for a process can be estimated based on a coking model. The coking model can comprise a pyrolytic coking term and a catalytic coking term. The pyrolytic term can be based on a concentration of a coking agent. The catalytic term can be based on a surface concentration of catalytically active sites. The surface concentration can change due to pyrolytic coke formation. For example, the catalytic term can be based on a concentration of ethylene. The process can comprise decomposition of hydrocarbon compounds.

At step 304, at least a portion of the process can be performed.

At step 306, a parameter for the process can be received. For example, receiving the parameter for the process can comprise monitoring in real-time the parameter for the process. As another example, the parameter can comprise at least one of a coil output temperature, tube metal temperature, and a pressure drop associated with a tube.

At step 308, an operation of the process can be adjusted based on the parameter. For example, the operation can comprise an anti-coking operation. As another example, adjusting the operation can comprise replacing the operation with an anti-coking operation. As an example, adjusting the operation can comprise adjusting the process in real-time in response to the monitoring. As another example, adjusting the operation can comprise modifying a time to at least one of end the process and interrupt the process. As a further example, adjusting the operation can comprise scheduling a time to clean a tube implementing the process.

At step 310, at least a portion of the process can be performed based on the adjusted operation of the process.

Figure 4:
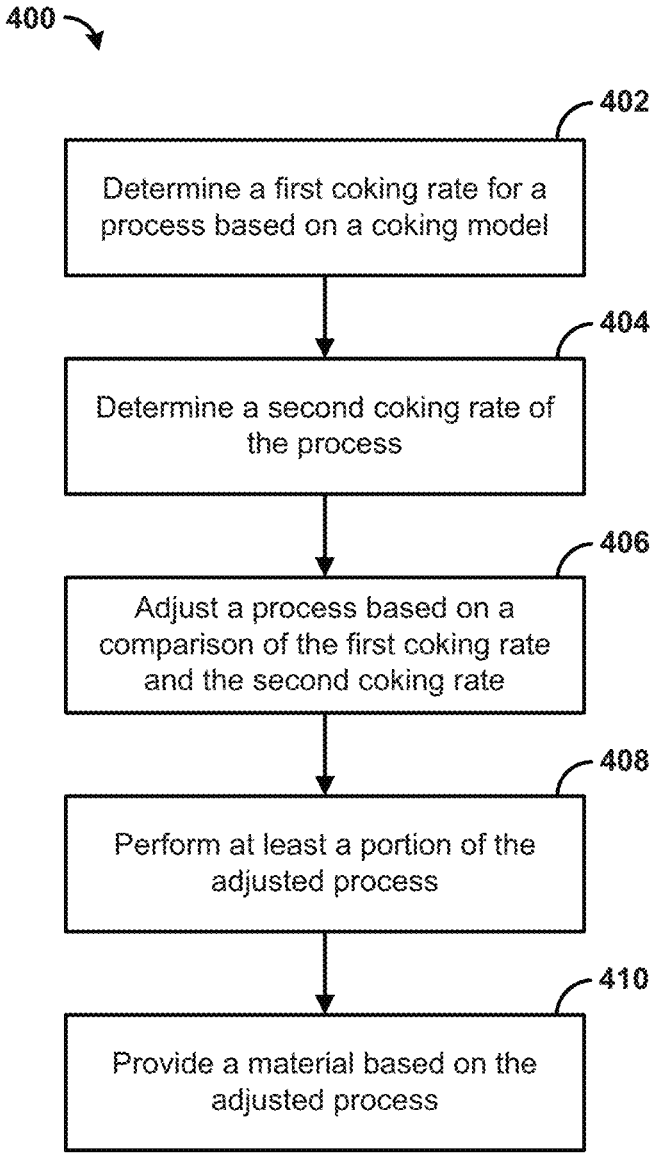
FIG. 4 is a flowchart illustrating another example method for managing a decomposition process.

FIG. 4 is a flowchart illustrating another example method 400 for managing a decomposition process. At step 402, a first coking rate can be determined for a process based on a coking model. The process can comprise decomposition of hydrocarbon compounds. The coking model can comprise a pyrolytic coking term and a catalytic coking term. The pyrolytic term can be based on the concentration of a coking agent. The catalytic term can be based on a surface concentration of catalytically active sites. The surface concentration can change due to pyrolytic coke formation. For example, the catalytic term can be based on a concentration of ethylene.

At step 404, a second coking rate of the process can be determined. For example, determining the second coking rate of the process can comprise monitoring in real-time a parameter for the process and determining the second coking rate based on the parameter and the coking model. For example, the parameter can comprise at least one of a coil output temperature, tube metal temperature, a pressure drop associated with a tube, and/or the like. The second coking rate can be indicative of the process after the anti-coking procedure is applied. The second coking rate can be determined based on the coking model.

At step 406, a process can be adjusted based on a comparison of the first coking rate and the second coking rate. For example, adjusting the process can comprise applying an anti-coking procedure. Applying the anti-coking procedure can comprise at least one of replacing a tube, coating a tube with a material, and adding a material configured to reduce or prevent formation of coke. As another example, adjusting the process can comprise adjusting the process in real-time in response to the monitoring. As a further example, adjusting the process can comprise modifying a time to at least one of end the process and interrupt the process. As yet another example, adjusting the process can comprise scheduling a time to clean a tube implementing the process.

At step 410, at least a portion of the adjusted process can be performed.

At step 412, a material can be provided based on the adjusted process. The material can comprise ethylene.

Figure 5:
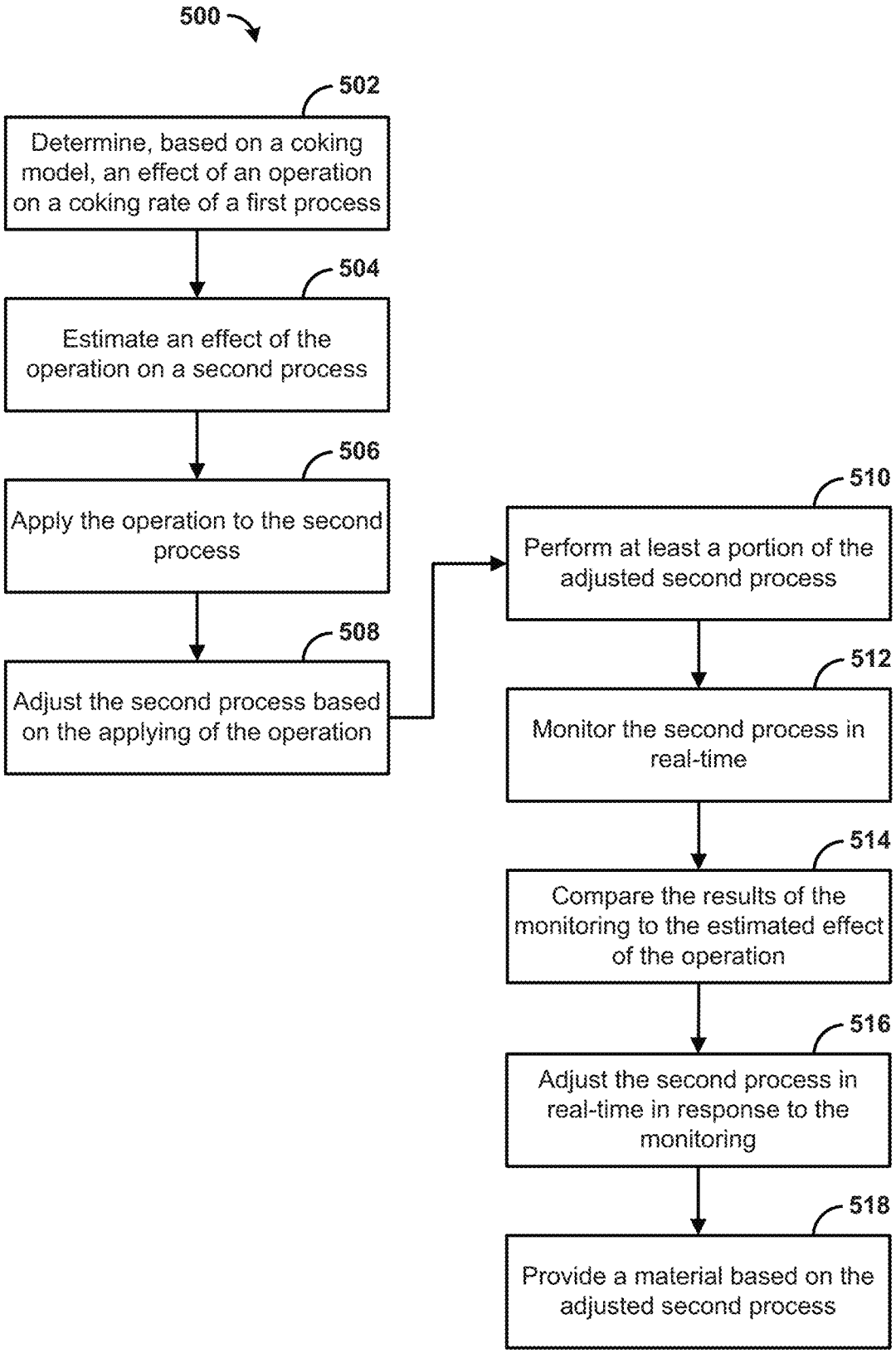
FIG. 5 is a flowchart illustrating another example method for managing a decomposition process.

FIG. 5 is a flowchart illustrating another example method 500 for managing a decomposition process. At step 502, an effect of an operation on a coking rate of a first process can be determined based on a coking model. The coking model can comprise a pyrolytic coking term and a catalytic coking term. The pyrolytic term can be based on the concentration of a coking agent. The catalytic term can be based on a surface concentration of catalytically active sites. The surface concentration can change due to pyrolytic coke formation. The catalytic term can be based on a concentration of ethylene. In one aspect, determining, based on the coking model, the effect of an operation on a coking rate of a first process can comprise determining a parameter of the first process indicative of the operation being performed on the first process and inputting the parameter into the coking model.

At step 504, an effect of the operation on a second process can be estimated. The estimating can be based on the coking model and the effect of the operation on the coking rate of the first process. The operation can comprise an anti-coking operation. The operation can comprise at least one of replacing a tube, coating a tube with a material, and adding a material configured to reduce or prevent formation of coke. The first process can be performed with a first furnace and the second process can be performed with a second furnace. The first process and/or second process can comprise decomposition of hydrocarbon compounds. The first furnace and the second furnace can both be configured to decompose hydrocarbon compounds. In one aspect, estimating the effect of the operation on a second process can comprise determining at least one operating parameter of the second process and inputting the at least one operation parameter into the coking model. The at least one operating parameter can comprise at least one of a coil output temperature, tube metal temperature, and a pressure drop associated with a tube.

At step 506, the operation can be applied to the second process. At step 508, the second process can be adjusted based on the applying of the operation. At step 510, at least a portion of the adjusted second process can be performed. At step 512, the second process can be monitored in real-time. At step 514, results of the monitoring can be compared to the estimated effect of the operation.

At step 516, the second process (e.g., adjusted second process) can be adjusted in real-time in response to the monitoring. Adjusting the second process in real-time can comprise modifying a time to at least one of end the second process and interrupt the second process. Adjusting the second process in real-time can comprise scheduling a time to clean a tube implementing the second process. At step 518, a material can be provided based on the adjusted second process. For example, the material can comprise ethylene.

Figure 6:
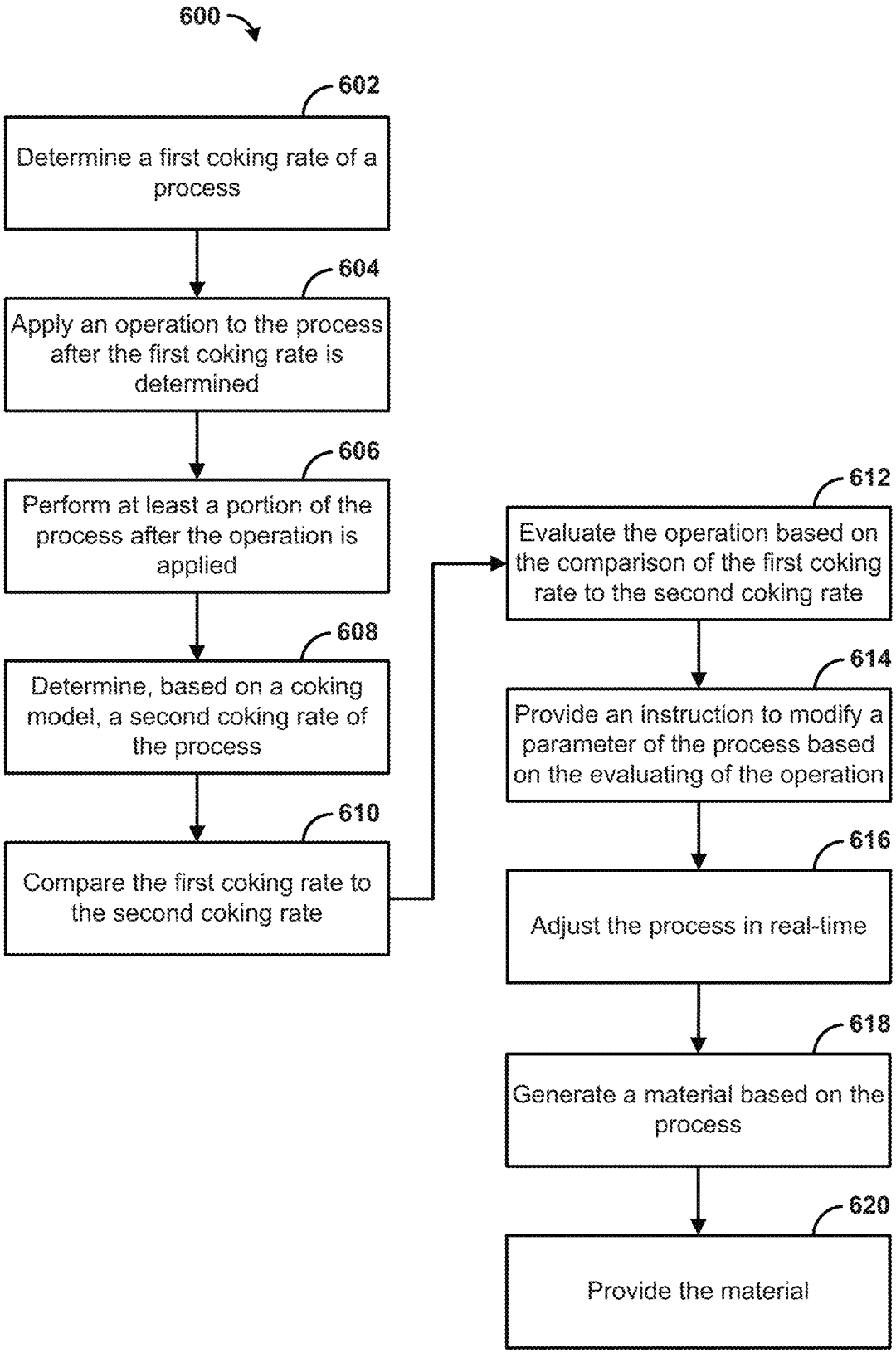
FIG. 6 is a flowchart illustrating another example method for managing a decomposition process.

FIG. 6 is a flowchart illustrating another example method 600 for managing a decomposition process. At step 602, determining a first coking rate of a process. The process can comprise decomposition of hydrocarbon compounds. For example, determining the first coking rate can comprise measuring at least one parameter indicative of an amount of coke produced by the process. The parameter can comprise at least one of a coil output temperature, tube metal temperature, and a pressure drop associated with a tube. The first coking rate can be determined based on a coking model. The coking model can comprise a catalytic coking term and a pyrolytic coking term. The pyrolytic term can be based on a concentration of a coking agent. The catalytic term can be based on a surface concentration of catalytically active sites. The surface concentration can change due to pyrolytic coke formation. The catalytic term is based on a concentration of ethylene.

At step 604, an operation can be applied to the process after the first coking rate is determined. The operation can comprise an anti-coking operation. the anti-coking operation can comprise at least one of replacing a tube, coating a tube with a material, and adding a material configured to reduce or prevent formation of coke.

At step 606, at least a portion of the process can be performed after the operation is applied. At step 608, a second coking rate of the process can be determined based on a coking model. The second coking rate can be indicative of the operation. For example, determining the second coking rate of the process can comprise monitoring in real-time a parameter for the process and determining the second coking rate based on the parameter and the coking model. The parameter can comprise at least one of a coil output temperature, tube metal temperature, and a pressure drop associated with a tube. At step 610, the first coking rate can be compared to the second coking rate.

At step 612, the operation can be evaluated based on the comparison of the first coking rate to the second coking rate. For example, evaluating the operation based on the comparison of the first coking rate to the second coking rate can comprise determining at least one of an amount of coking reduction due to the operation, a difference in an amount of time the process can be performed for when the operation is applied to the process and an amount of time the process can be performed form when the operation is not applied to the process.

At step 614, an instruction to modify a parameter of the process can be provided based on the evaluating of the operation. The parameter can comprise a time duration to perform the process.

At step 616, the process can be adjusted in real-time. For example the process can be adjusted in real-time in response to the monitoring. The process can be adjusted in real-time in response to the instruction. Adjusting the process in real-time can comprise modifying a time to at least one of end the process and interrupt the process. Adjusting the process can comprise scheduling a time to clean a tube implementing the process. At step 618, a material can be generated based on the process. The material can comprise ethylene. At step 620, the material can be provided.

Figure 7:
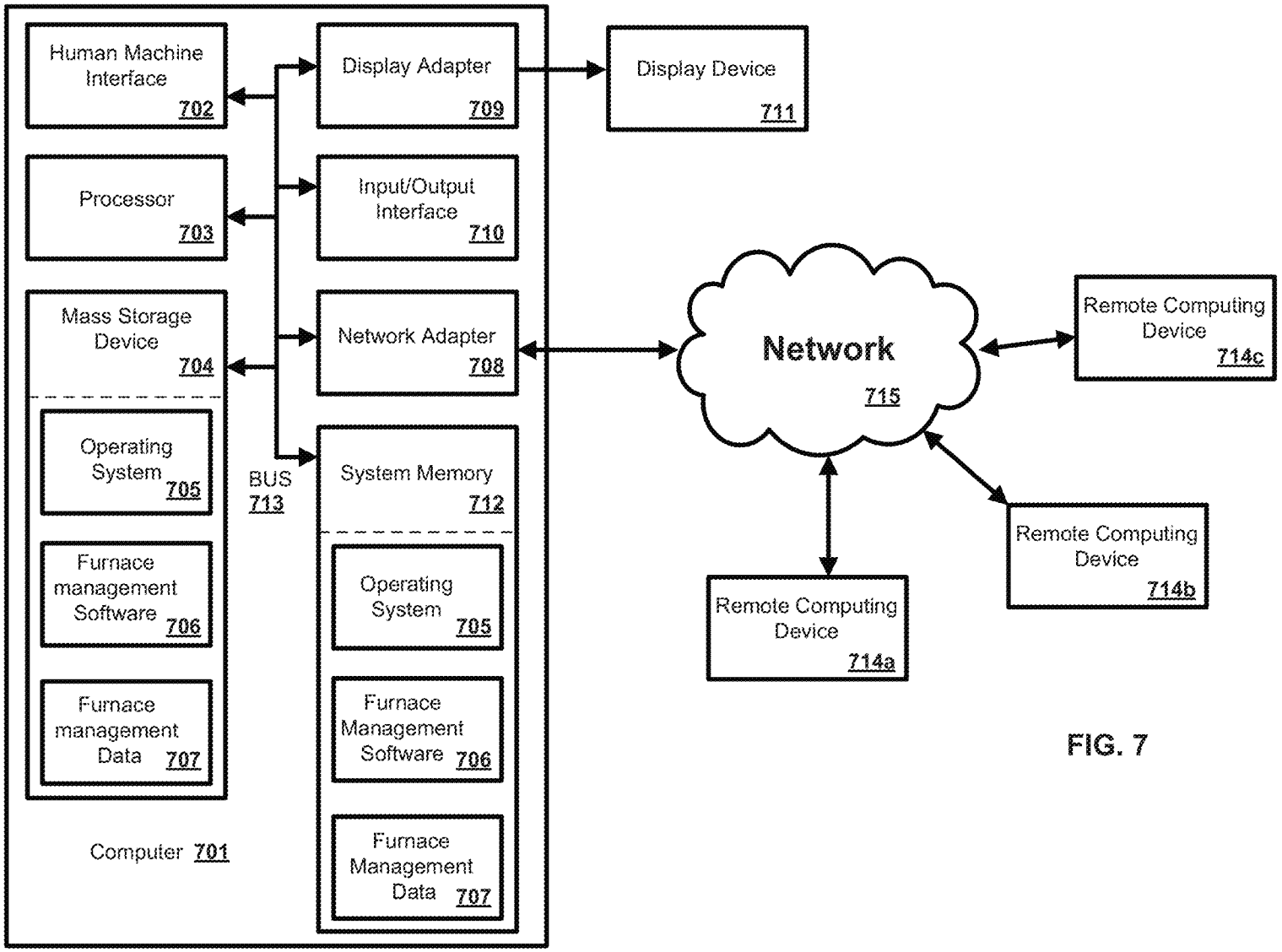
FIG. 7 is a block diagram illustrating an example computing device in which the present methods and systems can be implemented.

In an exemplary aspect, the methods and systems can be implemented on a computer 701 as illustrated in FIG. 7 and described below. By way of example, the first furnace 102, second furnace 104, and/or management device 116 of FIG. 1 can be a computer as illustrated in FIG. 7. Similarly, the methods and systems disclosed can utilize one or more computers to perform one or more functions in one or more locations. FIG. 7 is a block diagram illustrating an exemplary operating environment for performing the disclosed methods. This exemplary operating environment is only an example of an operating environment and is not intended to suggest any limitation as to the scope of use or functionality of operating environment architecture. Neither should the operating environment be interpreted as having any dependency or requirement relating to any one or combination of components illustrated in the exemplary operating environment.

The present methods and systems can be operational with numerous other general purpose or special purpose computing system environments or configurations. Examples of well known computing systems, environments, and/or configurations that can be suitable for use with the systems and methods comprise, but are not limited to, personal computers, server computers, laptop devices, and multiprocessor systems. Additional examples comprise set top boxes, programmable consumer electronics, network PCs, minicomputers, mainframe computers, distributed computing environments that comprise any of the above systems or devices, and the like.

The processing of the disclosed methods and systems can be performed by software components. The disclosed systems and methods can be described in the general context of computer-executable instructions, such as program modules, being executed by one or more computers or other devices. Generally, program modules comprise computer code, routines, programs, objects, components, data structures, etc. that perform particular tasks or implement particular abstract data types. The disclosed methods can also be practiced in grid-based and distributed computing environments where tasks are performed by remote processing devices that are linked through a communications network. In a distributed computing environment, program modules can be located in both local and remote computer storage media including memory storage devices.

Further, one skilled in the art will appreciate that the systems and methods disclosed herein can be implemented via a general-purpose computing device in the form of a computer 701. The components of the computer 701 can comprise, but are not limited to, one or more processors or processing units 703, a system memory 712, and a system bus 713 that couples various system components including the processor 703 to the system memory 712. In the case of multiple processing units 703, the system can utilize parallel computing.

The system bus 713 represents one or more of several possible types of bus structures, including a memory bus or memory controller, a peripheral bus, an accelerated graphics port, and a processor or local bus using any of a variety of bus architectures. By way of example, such architectures can comprise an Industry Standard Architecture (ISA) bus, a Micro Channel Architecture (MCA) bus, an Enhanced ISA (EISA) bus, a Video Electronics Standards Association (VESA) local bus, an Accelerated Graphics Port (AGP) bus, and a Peripheral Component Interconnects (PCI), a PCI-Express bus, a Personal Computer Memory Card Industry Association (PCMCIA), Universal Serial Bus (USB) and the like. The bus 713, and all buses specified in this description can also be implemented over a wired or wireless network connection and each of the subsystems, including the processor 703, a mass storage device 704, an operating system 705, furnace management software 706, furnace management data 707, a network adapter 708, system memory 712, an Input/Output Interface 710, a display adapter 709, a display device 711, and a human machine interface 702, can be contained within one or more remote computing devices 714*a,b,c* at physically separate locations, connected through buses of this form, in effect implementing a fully distributed system.

The computer 701 typically comprises a variety of computer readable media. Exemplary readable media can be any available media that is accessible by the computer 701 and comprises, for example and not meant to be limiting, both volatile and non-volatile media, removable and non-removable media. The system memory 712 comprises computer readable media in the form of volatile memory, such as random access memory (RAM), and/or non-volatile memory, such as read only memory (ROM). The system memory 712 typically contains data such as furnace management data 707 and/or program modules such as operating system 705 and furnace management software 706 that are immediately accessible to and/or are presently operated on by the processing unit 703.

In another aspect, the computer 701 can also comprise other removable/non-removable, volatile/non-volatile computer storage media. By way of example, FIG. 7 illustrates a mass storage device 704 which can provide non-volatile storage of computer code, computer readable instructions, data structures, program modules, and other data for the computer 701. For example and not meant to be limiting, a mass storage device 704 can be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like.

Optionally, any number of program modules can be stored on the mass storage device 704, including by way of example, an operating system 705 and furnace management software 706. Each of the operating system 705 and furnace management software 706 (or some combination thereof) can comprise elements of the programming and the furnace management software 706. Furnace management data 707 can also be stored on the mass storage device 704. Furnace management data 707 can be stored in any of one or more databases known in the art. Examples of such databases comprise, DB2®, Microsoft® Access, Microsoft® SQL Server, Oracle®, mySQL, PostgreSQL, and the like. The databases can be centralized or distributed across multiple systems.

In another aspect, the user can enter commands and information into the computer 701 via an input device (not shown). Examples of such input devices comprise, but are not limited to, a keyboard, pointing device (e.g., a "mouse"), a microphone, a joystick, a scanner, tactile input devices such as gloves, and other body coverings, and the like These and other input devices can be connected to the processing unit 703 via a human machine interface 702 that is coupled to the system bus 713, but can be connected by other interface and bus structures, such as a parallel port, game port, an IEEE 1394 Port (also known as a Firewire port), a serial port, or a universal serial bus (USB).

In yet another aspect, a display device 711 can also be connected to the system bus 713 via an interface, such as a display adapter 709. It is contemplated that the computer 701 can have more than one display adapter 709 and the computer 701 can have more than one display device 711. For example, a display device can be a monitor, an LCD (Liquid Crystal Display), or a projector. In addition to the display device 711, other output peripheral devices can comprise components such as speakers (not shown) and a printer (not shown) which can be connected to the computer 701 via Input/Output Interface 710. Any step and/or result of the methods can be output in any form to an output device. Such output can be any form of visual representation, including, but not limited to, textual, graphical, animation, audio, tactile, and the like. The display 711 and computer 701 can be part of one device, or separate devices.

The computer 701 can operate in a networked environment using logical connections to one or more remote computing devices 714*a,b,c*. By way of example, a remote computing device can be a personal computer, portable computer, smartphone, a server, a router, a network computer, a peer device or other common network node, and so on. Logical connections between the computer 701 and a remote computing device 714*a,b,c* can be made via a network 715, such as a local area network (LAN) and/or a general wide area network (WAN). Such network connections can be through a network adapter 708. A network adapter 708 can be implemented in both wired and wireless environments. Such networking environments are conventional and commonplace in dwellings, offices, enterprise-wide computer networks, intranets, and the Internet.

For purposes of illustration, application programs and other executable program components such as the operating system 705 are illustrated herein as discrete blocks, although it is recognized that such programs and components reside at various times in different storage components of the computing device 701, and are executed by the data processor(s) of the computer. An implementation of furnace management software 706 can be stored on or transmitted across some form of computer readable media. Any of the disclosed methods can be performed by computer readable instructions embodied on computer readable media. Computer readable media can be any available media that can be accessed by a computer. By way of example and not meant to be limiting, computer readable media can comprise "computer storage media" and "communications media." "Computer storage media" comprise volatile and non-volatile, removable and non-removable media implemented in any methods or technology for storage of information such as computer readable instructions, data structures, program modules, or other data. Exemplary computer storage media comprises, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

The methods and systems can employ Artificial Intelligence techniques such as machine learning and iterative learning. Examples of such techniques include, but are not limited to, expert systems, case based reasoning, Bayesian networks, behavior based AI, neural networks, fuzzy systems, evolutionary computation (e.g. genetic algorithms), swarm intelligence (e.g. ant algorithms), and hybrid intelligent systems (e.g. Expert inference rules generated through a neural network or production rules from statistical learning).

The following examples are put forth so as to provide those of ordinary skill in the art with a complete disclosure and description of how the compounds, compositions, articles, devices and/or methods claimed herein are made and evaluated, and are intended to be purely exemplary and are not intended to limit the scope of the methods and systems. Efforts have been made to ensure accuracy with respect to numbers (e.g., amounts, temperature, etc.), but some errors and deviations should be accounted for. Unless indicated otherwise, parts are parts by weight, temperature is in ° C. or is at ambient temperature, and pressure is at or near atmospheric.

Figure 9A:
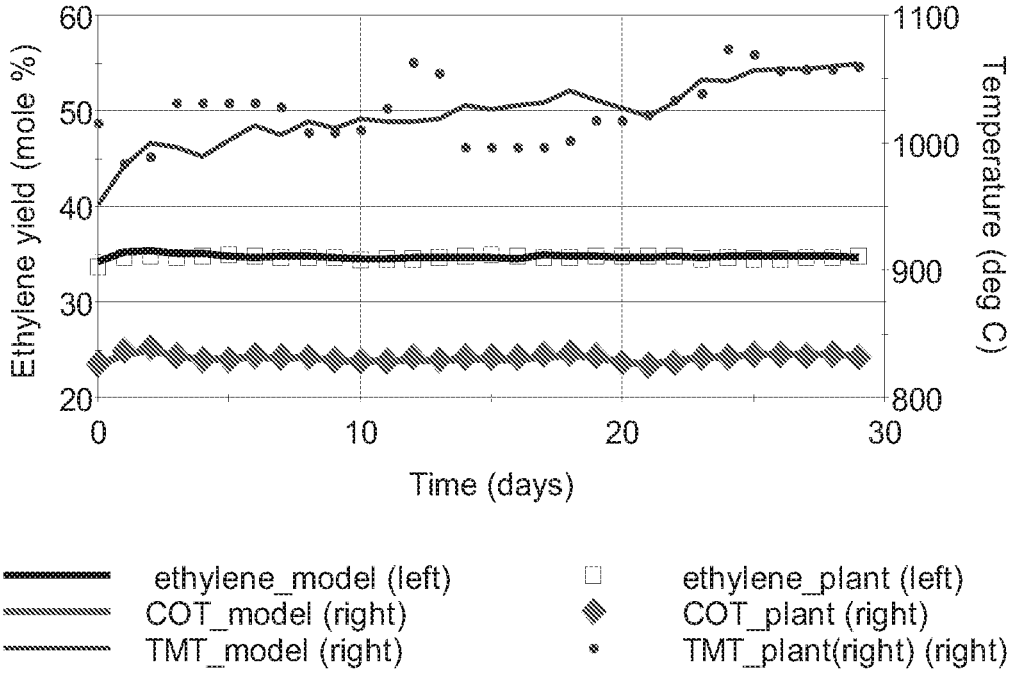
FIG. 9A is a graph illustrating temperature and ethylene yields over time as predicted by an example coking model for a first furnace run cycle of an ethylene furnace.
Figure 9B:
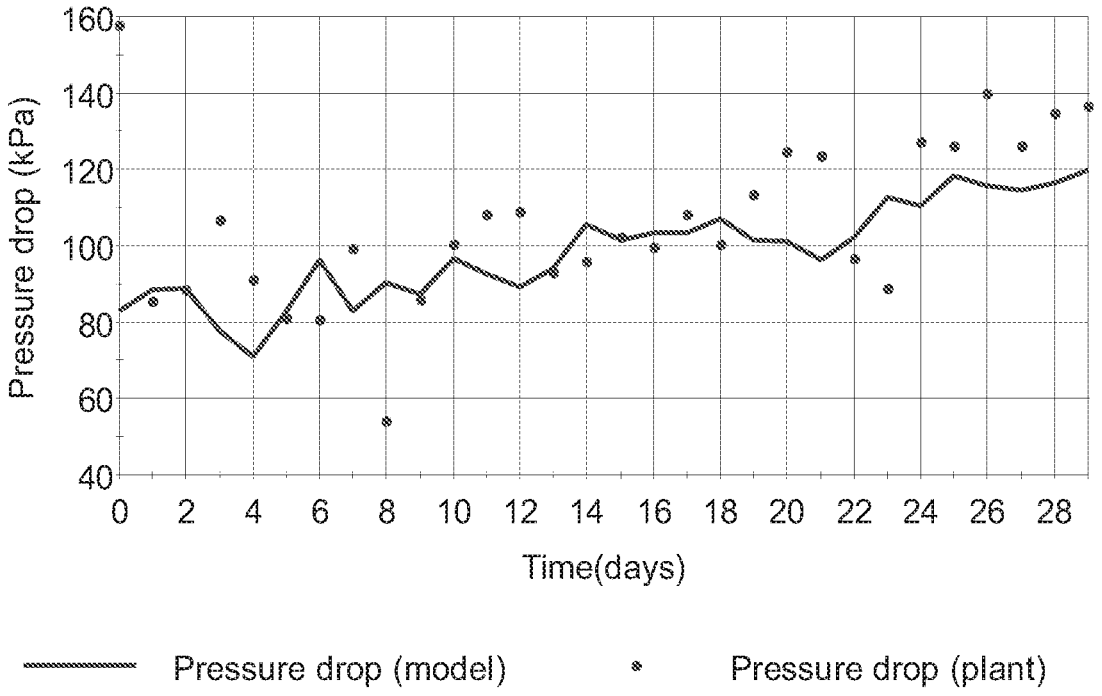
FIG. 9B is a graph illustrating pressure drop over time as predicted by an example coking model for a first furnace run cycle of an ethylene furnace.
Figure 10A:
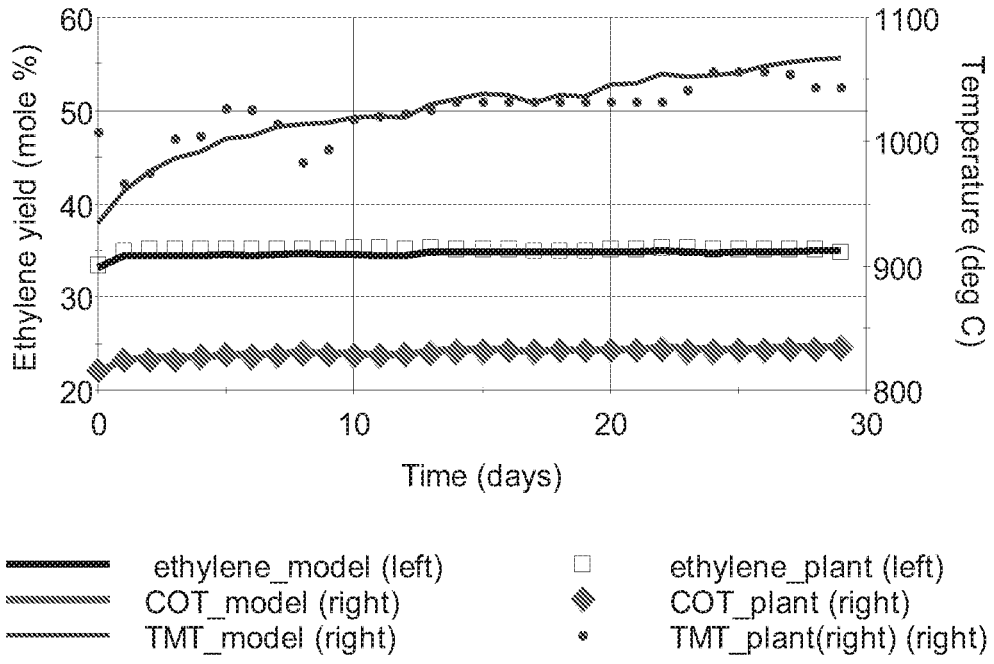
FIG. 10A is a graph illustrating temperature and ethylene yields over time as predicted by an example coking model for a second furnace run cycle of an ethylene furnace.
Figure 10B:
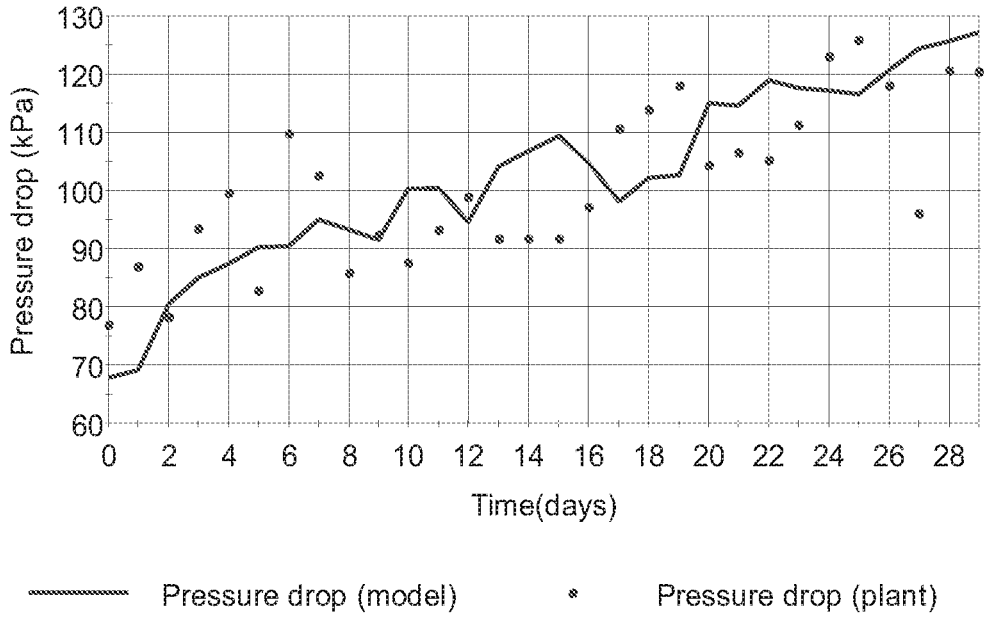
FIG. 10B is a graph illustrating pressure drop over time as predicted by an example coking model for a second furnace run cycle of an ethylene furnace.

FIG. 8A shows example parameters for an example coking model. The example parameters can be used to validate the coking model on a process on which an anti-coking procedure is not applied. FIG. 8B shows a correlation matrix of parameters for the coking model. FIG. 9A is a graph illustrating temperature and ethylene yields over time as predicted by an example coking model for a first furnace run cycle of an ethylene furnace. FIG. 9B is a graph illustrating pressure drop over time as predicted by an example coking model for a first furnace run cycle of an ethylene furnace. FIG. 10A is a graph illustrating temperature and ethylene yields over time as predicted by an example coking model for a second furnace run cycle of an ethylene furnace. FIG. 10B is a graph illustrating pressure drop over time as predicted by an example coking model for a second furnace run cycle of an ethylene furnace.

Figure 11A:
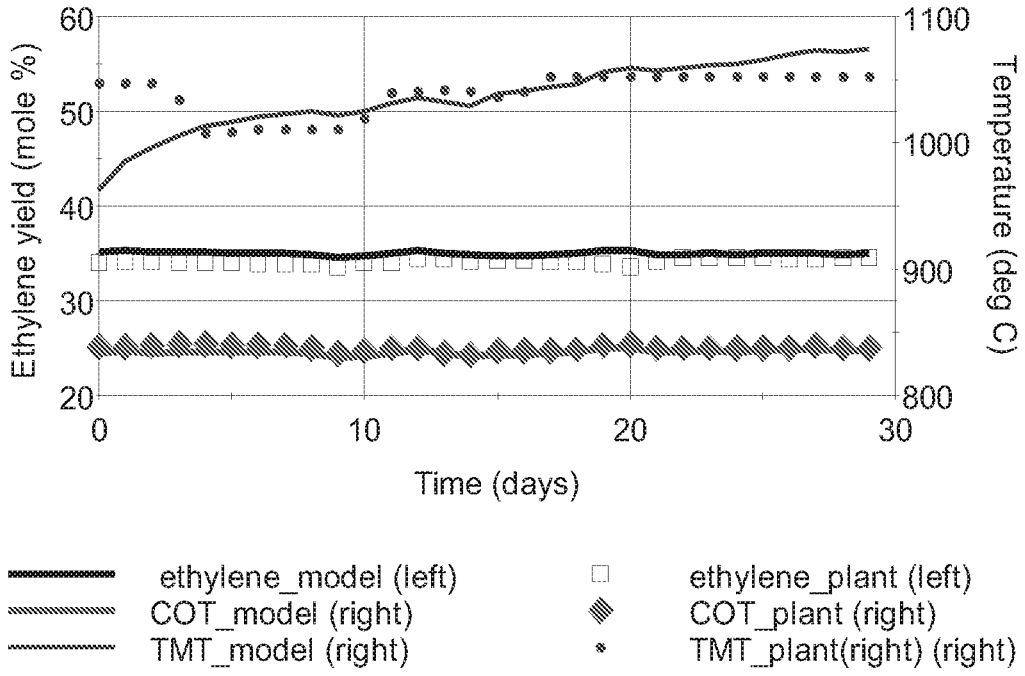
FIG. 11A is a graph illustrating temperature and ethylene yields over time as predicted by an example coking model for a third furnace run cycle of an ethylene furnace.
Figure 11B:
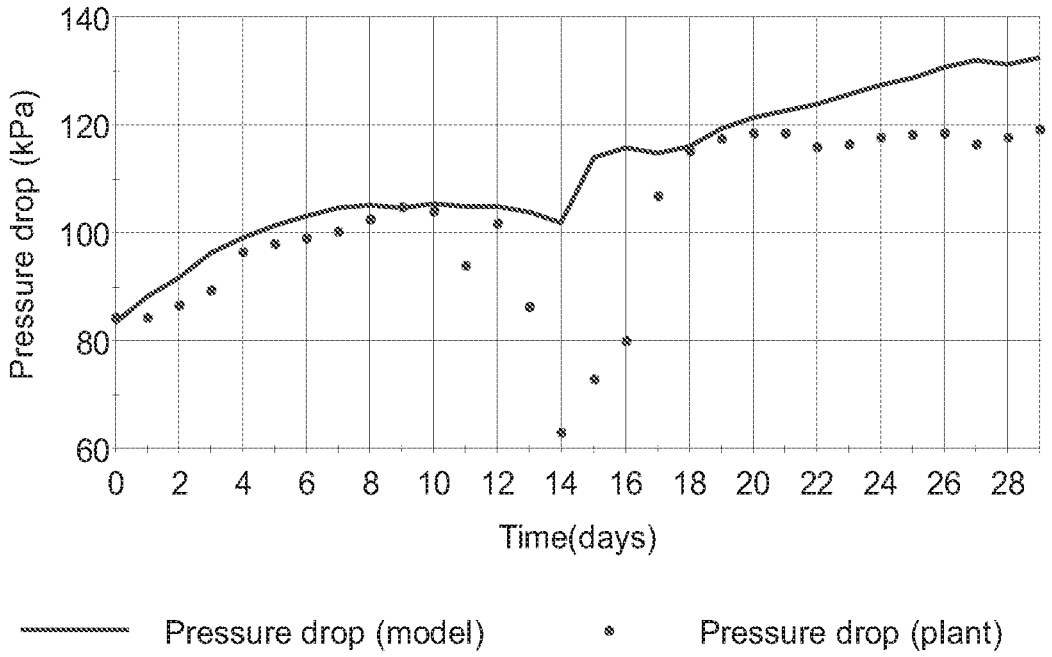
FIG. 11B is a graph illustrating pressure drop over time as predicted by an example coking model for a third furnace run cycle of an ethylene furnace.
Figure 13A:
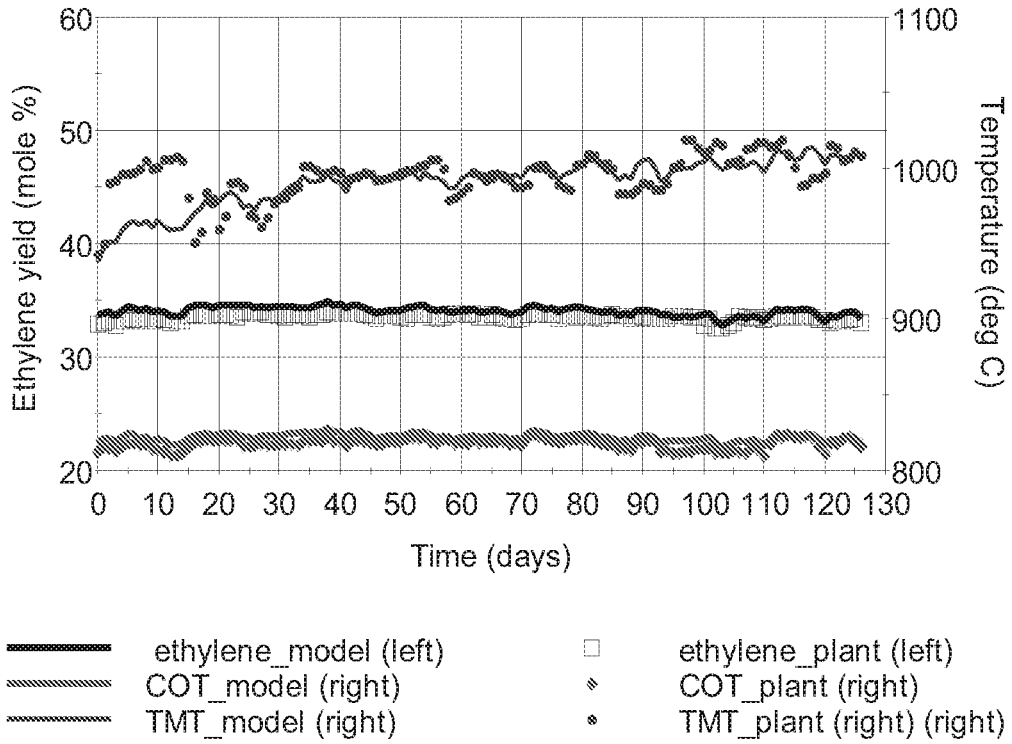
FIG. 13A is a graph illustrating temperature and ethylene yields over time as predicted by an example coking model for a fourth furnace run cycle of an ethylene furnace.
Figure 13B:
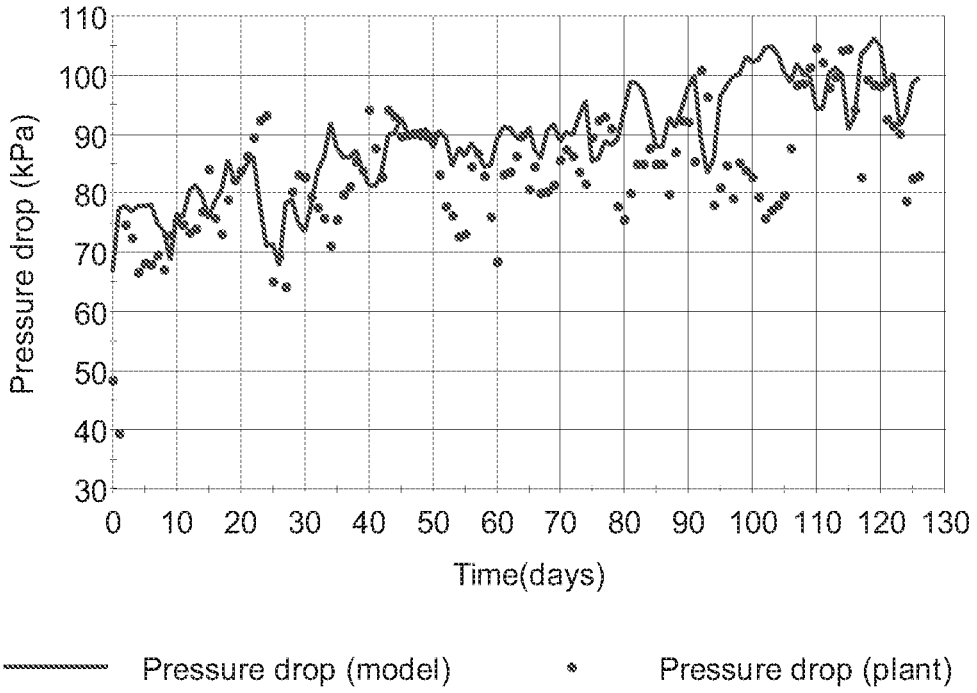
FIG. 13B is a graph illustrating pressure drop over time as predicted by an example coking model for a fourth furnace run cycle of an ethylene furnace.

FIG. 11A is a graph illustrating temperature and ethylene yields over time as predicted by an example coking model for a third furnace run cycle of an ethylene furnace. FIG. 11B is a graph illustrating pressure drop over time as predicted by an example coking model for a third furnace run cycle of an ethylene furnace. FIG. 12A shows example parameters for an example coking model for an ethylene furnace after an anti-coking procedure is applied. FIG. 12B shows a correlation matrix of parameters for the coking model. FIG. 13A is a graph illustrating temperature and ethylene yields over time as predicted by an example coking model for a fourth furnace run cycle of an ethylene furnace. In one aspect, the application of an anti-coking procedure is assumed. FIG. 13B is a graph illustrating pressure drop over time as predicted by an example coking model for a fourth furnace run cycle of an ethylene furnace.

Figure 14A:
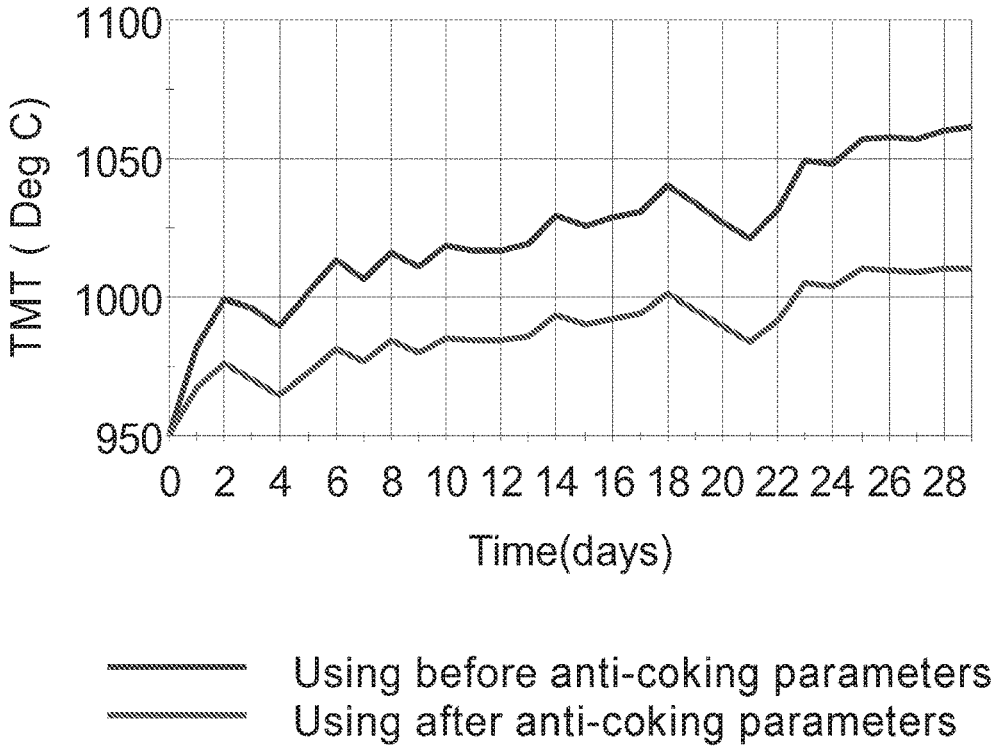
FIG. 14A is a graph of tube metal temperatures (TMT) predicted by a coking model comparing the results of the model.
Figure 14B:
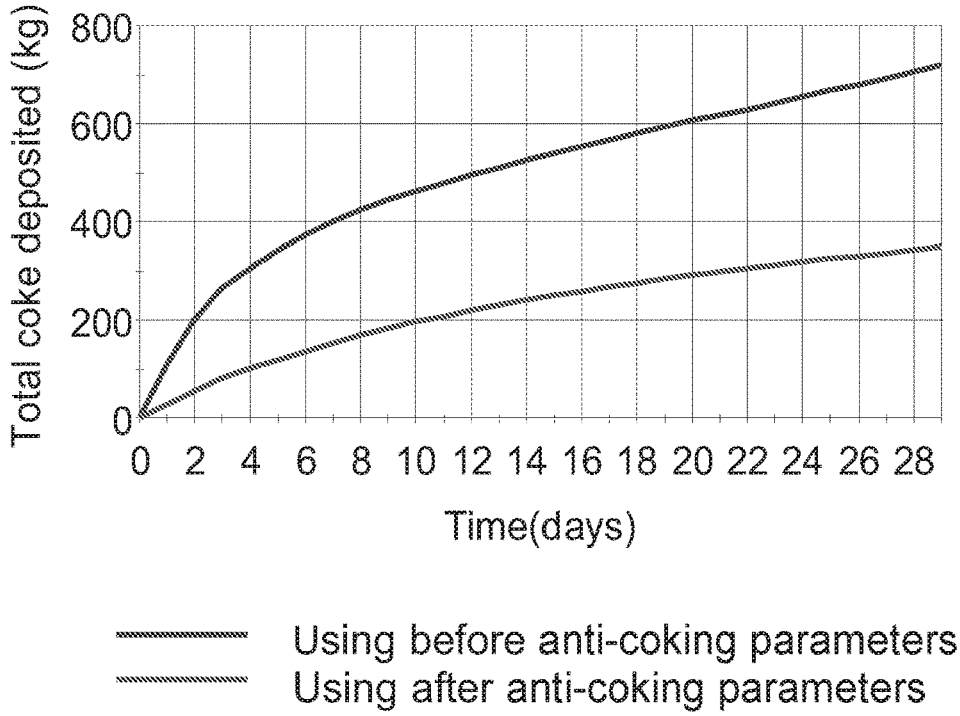
FIG. 14B is a graph of total coke deposited predicted by a coking model comparing the results of the model.
Figure 14C:
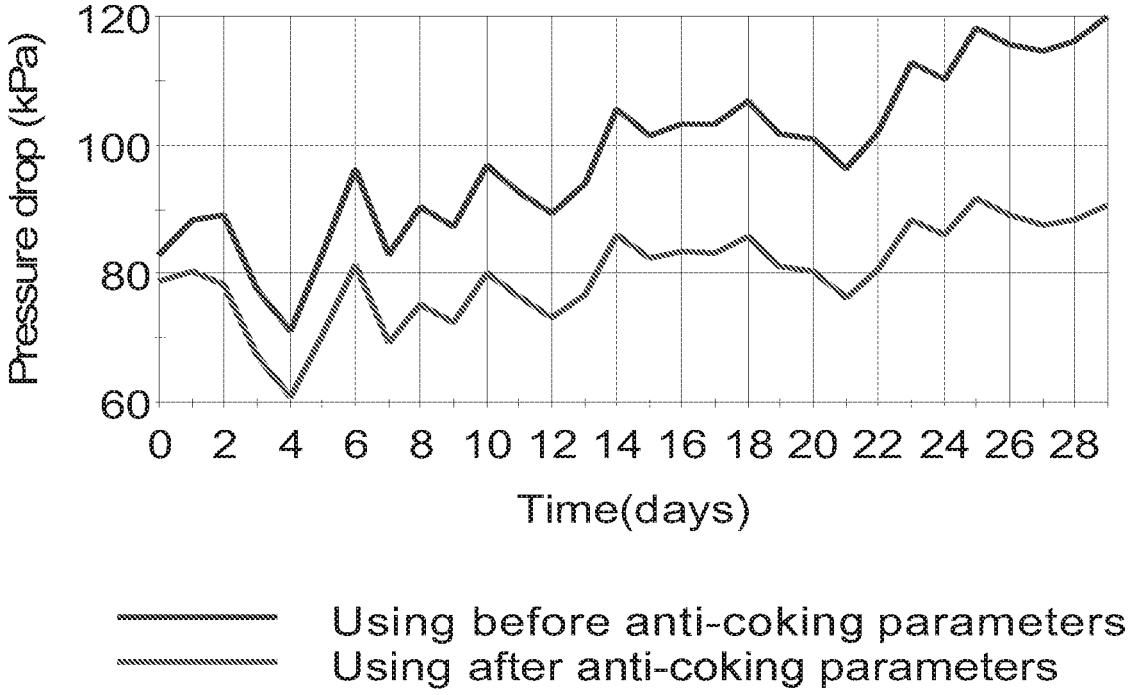
FIG. 14C is a graph of pressure drop predicted by a coking model comparing the results of the model.
Figure 15:
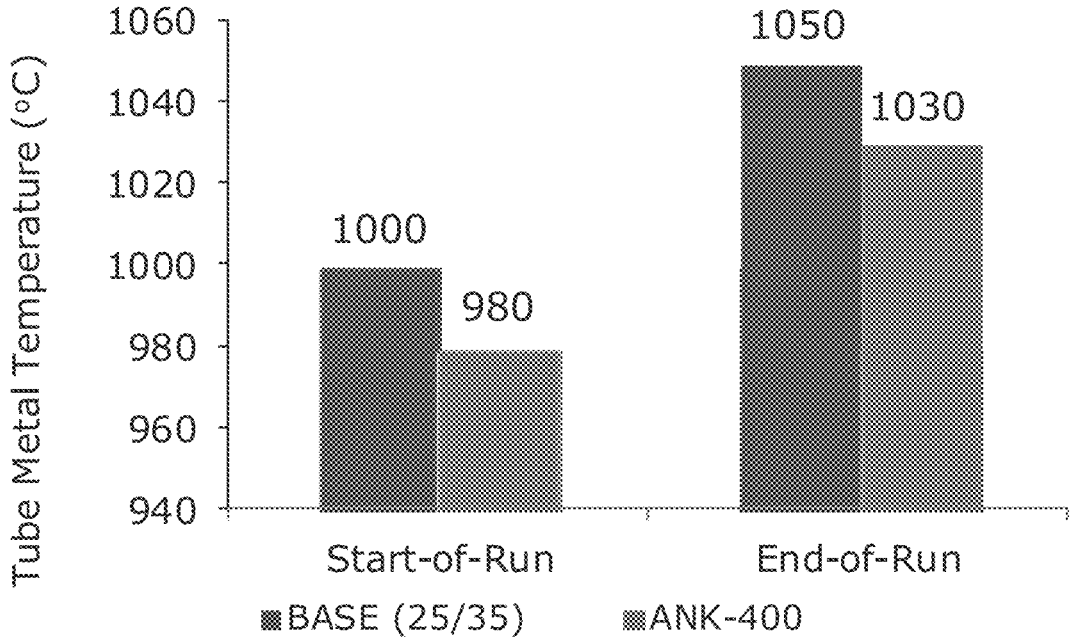
FIG. 15 is a bar graph comparing tube metal temperature predicted for two different anti-coking procedures.

FIG. 14A is a graph of tube metal temperatures (TMT) predicted by a coking model comparing the results of the model using parameters based on the assumption that an anti-coking procedure is applied to results of the model using parameters that are not based on an assumption that an anti-coking procedure is applied. FIG. 14B is a graph of total coke deposited predicted by a coking model comparing the results of the model using parameters based on the assumption that an anti-coking procedure is applied to results of the model using parameters that are not based on an assumption that an anti-coking procedure is applied. FIG. 14C is a graph of pressure drop predicted by a coking model comparing the results of the model using parameters based on the assumption that an anti-coking procedure is applied to results of the model using parameters that are not based on an assumption that an anti-coking procedure is applied. FIG. 15 is a bar graph comparing tube metal temperature predicted for two different anti-coking procedures.

The disclosed methods and apparatuses include at least the following aspects.

Aspect 1: A method, comprising:

estimating a coking rate for a process based on a coking model, wherein the coking model comprises a pyrolytic coking term and a catalytic coking term;

performing at least a portion of the process;

receiving a parameter for the process; and adjusting an operation of the process based on the parameter.

Aspect 2: The method of aspect 1, further comprising performing at least a portion of the process based on the adjusted operation of the process.

Aspect 3: The method of any of aspect 1-2, wherein the operation is an anti-coking operation.

Aspect 4: The method of any of aspect 1-3, wherein receiving the parameter for the process comprises monitoring in real-time the parameter for the process.

Aspect 5: The method of aspect 4, wherein adjusting the operation comprises adjusting the process in real-time in response to the monitoring.

Aspect 6: The method of any of aspects 1-5, wherein adjusting the operation comprises modifying a time to at least one of end the process and interrupt the process.

Aspect 7: The method of any of aspects 1-6, wherein adjusting the operation comprises scheduling a time to clean a tube implementing the process.

Aspect 8: The method of any of aspects 1-7, wherein the pyrolytic term is based on a concentration of a coking agent.

Aspect 9: The method of any of aspects 1-8, wherein the catalytic term is based on a surface concentration of catalytically active sites.

Aspect 10: The method of aspect 9, wherein the surface concentration changes due to pyrolytic coke formation.

Aspect 11: The method of any of aspects 1-10, wherein the catalytic term is based on a concentration of ethylene.

Aspect 12: The method of any of aspects 1-11, wherein the process comprises decomposition of hydrocarbon compounds.

Aspect 13: The method of any of aspects 1-12, wherein the parameter comprises at least one of a coil output temperature, tube metal temperature, and a pressure drop associated with a tube.

Aspect 14: A method, comprising:

determining a first coking rate for a process based on a coking model, wherein the coking model comprises a pyrolytic coking term and a catalytic coking term;

determining a second coking rate of the process; and adjusting a process based on a comparison of the first coking rate and the second coking rate.

Aspect 15: The method of aspect 14, wherein the second coking rate is determined based on the coking model.

Aspect 16: The method of any of aspects 14-15, wherein adjusting the process comprises applying an anti-coking procedure.

Aspect 17: The method of aspect 16, wherein applying the anti-coking procedure comprises at least one of replacing a tube, coating a tube with a material, and adding a material configured to reduce or prevent formation of coke.

Aspect 18: The method of any of aspects 16-17, wherein the second coking rate is indicative of the process after the anti-coking procedure is applied.

Aspect 19: The method of any of aspects 14-18, further comprising performing at least a portion of the adjusted process.

Aspect 20: The method of any of aspects 14-19, further comprising providing a material based on the adjusted process.

Aspect 21: The method of aspect 20, wherein the material is ethylene.

Aspect 22: The method of any of aspects 14-21, wherein determining the second coking rate of the process comprises monitoring in real-time a parameter for the process and determining the second coking rate based on the parameter and the coking model.

Aspect 23: The method of aspect 22, wherein adjusting the process comprises adjusting the process in real-time in response to the monitoring.

Aspect 24: The method of any of aspects 22-23, wherein the parameter comprises at least one of a coil output temperature, tube metal temperature, and a pressure drop associated with a tube.

Aspect 25: The method of any of aspects 14-24, wherein adjusting the process comprises modifying a time to at least one of end the process and interrupt the process.

Aspect 26: The method of any of aspects 14-25, wherein adjusting the process comprises scheduling a time to clean a tube implementing the process.

Aspect 27: The method of any of aspects 14-26, wherein the pyrolytic term is based on the concentration of a coking agent.

Aspect 28: The method of any of aspects 14-27, wherein the catalytic term is based on a surface concentration of catalytically active sites.

Aspect 29: The method of aspect 28, wherein the surface concentration changes due to pyrolytic coke formation.

Aspect 30: The method of any of aspects 14-29, wherein the catalytic term is based on a concentration of ethylene.

Aspect 31: The method of any of aspects 14-30, wherein the process comprises decomposition of hydrocarbon compounds.

Aspect 32: A method, comprising:

determining, based on a coking model, an effect of an operation on a coking rate of a first process, wherein the coking model comprises a pyrolytic coking term and a catalytic coking term; and estimating an effect of the operation on a second process, wherein the estimating is based on the coking model and the effect of the operation on the coking rate of the first process.

Aspect 33: The method of aspect 32, wherein the operation is an anti-coking operation.

Aspect 34: The method of any of aspects 32-33, wherein the first process is performed with a first furnace and the second process is performed with a second furnace.

Aspect 35: The method of aspect 34, wherein the first furnace and the second furnace are both configured to decompose hydrocarbon compounds.

Aspect 36: The method of any of aspects 32-35, wherein determining, based on the coking model, the effect of an operation on a coking rate of a first process comprises determining a parameter of the first process indicative of the operation being performed on the first process and inputting the parameter into the coking model.

Aspect 37: The method of any of aspects 32-36, wherein estimating the effect of the operation on a second process comprises determining at least one operating parameter of the second process and inputting the at least one operation parameter into the coking model.

Aspect 38: The method of aspect 37, wherein the at least one operating parameter comprises at least one of a coil output temperature, tube metal temperature, and a pressure drop associated with a tube.

Aspect 39: The method of any of aspects 32-38, further comprising applying the operation to the second process.

Aspect 40: The method of aspect 39, further comprising adjusting the second process based on the applying of the operation.

Aspect 41: The method of aspect 40, further comprising performing at least a portion of the adjusted second process.

Aspect 42: The method of any of aspects 40-41, further comprising providing a material based on the adjusted second process.

Aspect 43: The method of aspect 42, wherein the material is ethylene.

Aspect 44: The method of any of aspects 32-43, wherein the operation comprises at least one of replacing a tube, coating a tube with a material, and adding a material configured to reduce or prevent formation of coke.

Aspect 45: The method of any of aspects 32-44, further comprising monitoring the second process in real-time and comparing results of the monitoring to the estimated effect of the operation.

Aspect 46: The method of aspect 45, further comprising adjusting the second process in real-time in response to the monitoring.

Aspect 47: The method of aspect 46, wherein adjusting the second process in real-time comprises modifying a time to at least one of end the second process and interrupt the second process.

Aspect 48: The method of any of aspects 46-47, wherein adjusting the second process in real-time comprises scheduling a time to clean a tube implementing the second process.

Aspect 49: The method of any of aspects 32-48, wherein the pyrolytic term is based on the concentration of a coking agent.

Aspect 50: The method of any of aspects 32-49, wherein the catalytic term is based on a surface concentration of catalytically active sites.

Aspect 51: The method of aspect 50, wherein the surface concentration changes due to pyrolytic coke formation.

Aspect 52: The method any of aspects 32-51, wherein the catalytic term is based on a concentration of ethylene.

Aspect 53: The method of any of aspects 32-52, wherein the second process comprises decomposition of hydrocarbon compounds.

Aspect 54: A method, comprising:

determining a first coking rate of a process;

applying an operation to the process after the first coking rate is determined;

determining, based on a coking model, a second coking rate of the process, wherein the second coking rate is indicative of the operation, and wherein the coking model comprises a catalytic coking term and a pyrolytic coking term;

comparing the first coking rate to the second coking rate; and evaluating the operation based on the comparison of the first coking rate to the second coking rate.

Aspect 55: The method of aspect 54, wherein the operation is an anti-coking operation.

Aspect 56: The method of aspect 55, wherein the anti-coking operation comprises at least one of replacing a tube, coating a tube with a material, and adding a material configured to reduce or prevent formation of coke.

Aspect 57: The method of any of aspects 54-56, wherein the first coking rate is determined based on the coking model.

Aspect 58: The method of any of aspects 54-57, wherein determining the first coking rate comprises measuring at least one parameter indicative of an amount of coke produced by the process.

Aspect 59: The method of aspect 58, wherein the parameter comprises at least one of a coil output temperature, tube metal temperature, and a pressure drop associated with a tube.

Aspect 60: The method of any of aspects 54-59, wherein evaluating the operation based on the comparison of the first coking rate to the second coking rate comprises determining at least one of an amount of coking reduction due to the operation, a difference in an amount of time the process can be performed for when the operation is applied to the process and an amount of time the process can be performed form when the operation is not applied to the process.

Aspect 61: The method of any of aspects 54-60, further comprising performing at least a portion of the process after the operation is applied.

Aspect 62: The method of any of aspects 54-61, further comprising providing an instruction to modify a parameter of the process based on the evaluating of the operation.

Aspect 63: The method of aspect 62, wherein the parameter is a time duration to perform the process.

Aspect 64: The method of any of aspects 54-63, further comprising:

generating a material based on the process; and providing the material.

Aspect 65: The method of aspect 64, wherein the material is ethylene.

Aspect 66: The method of any of aspects 54-65, wherein determining the second coking rate of the process comprises monitoring in real-time a parameter for the process and determining the second coking rate based on the parameter and the coking model.

Aspect 67: The method of aspect 66, wherein the parameter comprises at least one of a coil output temperature, tube metal temperature, and a pressure drop associated with a tube.

Aspect 68: The method of any of aspects 66-67, further comprising adjusting the process in real-time in response to the monitoring.

Aspect 69: The method of aspect 68, wherein adjusting the process in real-time comprises modifying a time to at least one of end the process and interrupt the process.

Aspect 70: The method of any of aspects 68-69, wherein adjusting the process comprises scheduling a time to clean a tube implementing the process.

Aspect 71: The method of any of aspects 54-70, wherein the pyrolytic term is based on a concentration of a coking agent.

Aspect 72: The method of any of aspects 54-71, wherein the catalytic term is based on a surface concentration of catalytically active sites.

Aspect 73: The method of aspects 72, wherein the surface concentration changes due to pyrolytic coke formation.

Aspect 74: The method of any of aspects 54-73, wherein the catalytic term is based on a concentration of ethylene.

Aspect 75: The method of any of aspects 54-74, wherein the process comprises decomposition of hydrocarbon compounds.

While the methods and systems have been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

What is claimed is:

1. A method for estimating the coking rate in an ethane cracking furnace to produce ethylene comprising the steps of:

estimating a coking rate for the cracking process in the furnace based on a coking model, wherein the coking model comprises a pyrolytic coking term wherein pyrolytic coke is formed and a catalytic coking term wherein catalytic coke is formed;

performing at least a portion of the cracking process;

receiving a parameter for the process;

providing a concentration of ethylene ($c_{ethylene}$) and of a coking agent ($c_a$*); and adjusting an operation of the process based on the parameter;

wherein the parameter comprises at least one member selected from the group consisting of a tube metal temperature, and a pressure drop associated with a tube, wherein the catalytic coking term is based on a surface concentration of catalytically active sites;

wherein the catalytic coking term is based on the concentration of ethylene ($c_{ethylene}$) and the pyrolytic coking term is based on the concentration of coking agent ($c_a$*);

wherein the coking rate ($r_{coking}(z)$) is defined for the coking model as in equation (1)

$$\tau_{coking}(z)=k_c c_a\cdot(z)+k_{cat}\varphi_{cat}(z)c_{ethylene}(z),\ z\in[0,L] \quad (1)$$

wherein the surface concentration of catalytically active sites, $C_{cat}$ can change with time due to pyrolytic coke formation, as follows:

$$\frac{d\varphi_{cat}(z)}{dt}=-k_c c_a\cdot(z)\varphi_{cat}(z),\ z\in[0,L]\quad \varphi_{cat}(z)=\left(\frac{c_{cat}}{c_{cat}^{max}}\right), \quad (2)$$

wherein $C_{cat}^{max}$ is the maximum surface concentration of catalytically active sites and with the initial condition:

$$\varphi_{cat}(z)=1,\ z\in[0,L],\ t=0.$$

2. The method of claim 1, further comprising performing at least a portion of the process based on the adjusted operation of the process.

3. The method of claim 1, wherein the operation is an anti-coking operation.

4. The method of claim 1, wherein receiving the parameter for the process comprises monitoring in real-time the parameter for the process.

5. The method of claim 4, wherein adjusting the operation comprises adjusting the process in real-time in response to the monitoring.

6. The method of claim 1, wherein adjusting the operation comprises at least one step selected from the group consisting of a) modifying a time to at least one of end the process and interrupt the process, and b) scheduling a time to clean a tube implementing the process.

7. The method of claim 6, wherein the adjusting of the operation comprises scheduling a time to clean a tube implementing the process.

8. A method for estimating the coking rate in a process to crack ethane to produce ethylene, comprising:

determining a first coking rate for the process based on a coking model, wherein the coking model comprises a pyrolytic coking term and a catalytic coking term;

determining a second coking rate of the process;

providing a concentration of ethylene ($c_{ethylene}$) and of a coking agent ($c_a$*); and adjusting a process or evaluating an operation based on a comparison of the first coking rate and the second coking rate; wherein determining the second coking rate of the process comprises monitoring in real-time a parameter for the process and determining the second coking rate based on the parameter or the coking model;

wherein adjusting the process comprises adjusting the process in real-time in response to the monitoring; and wherein the parameter comprises at least one of a tube metal temperature, and a pressure drop associated with a tube, and wherein the catalytic coking term is based on a surface concentration of catalytically active sites;

wherein the catalytic term is based on the concentration of ethylene ($C_{ethylene}$) and the pyrolytic coking term is based on the concentration of coking agent ($c_a$*);

wherein the coking rate ($r_{coking}(z)$) is defined for the coking model as in equation (1)

$$\tau_{coking}(z)=k_c c_a\cdot(z)+k_{cat}\varphi_{cat}(z)c_{ethylene}(z),\ z\epsilon[0,\ L] \quad (1)$$

wherein the surface concentration of catalytically active sites, Ccat can change with time due to pyrolytic coke formation, as follows:

$$\frac{d\varphi_{cat}(z)}{dt}=-k_c c_a\cdot(z)\varphi_{cat}(z),\ z\in[0,\ L]\ \ \varphi_{cat}(z)=\left(\frac{c_{cat}}{c_{cat}^{max}}\right), \quad (2)$$

wherein $c_{cat}^{max}$ the maximum surface concentration of catalytically active sites and with the initial condition:

$\varphi_{cat}(z)=1$, $z\epsilon[0,L]$, $t=0$.

9. The method of claim 8, wherein adjusting the process comprises applying an anti-coking procedure.

10. The method of claim 9, wherein applying the anti-coking procedure comprises at least one of replacing a tube, coating a tube with a material, and adding a material configured to reduce or prevent formation of coke.

11. The method of claim 9, wherein the second coking rate is indicative of the process after the anti-coking procedure is applied.

12. The method of claim 9, wherein adjusting the process comprises a member selected from the group consisting of a) adjusting the process in real-time in response to the monitoring, b) modifying a time to end the process, c) modifying a time to interrupt the process, and d) scheduling a time to clean a tube implementing the process.

13. A method for estimating the coking rates ethane cracking furnaces to produce ethylene, comprising:

determining, based on a coking model, an effect of an operation on a coking rate of a first process, wherein the coking model comprises a pyrolyticcoking term and a catalytic cokingterm;

providing a concentration of ethylene ($c_{ethylene}$) and of a coking agent ($c_a$*); and estimating an effect of the operation on a second process, wherein the estimating is based on the coking model and the effect of the operation on the coking rate of the first process, wherein the first process is performed with a first furnace and the second process is performed with a second furnace, wherein the first furnace and the second furnace are both configured to decompose hydrocarbon compounds, and wherein the catalytic coking term is based on a surface concentration of catalytically active sites;

wherein the catalytic term can be based on a concentration of ethylene;

wherein the catalytic term is based on the concentration of ethylene ($C_{ethylene}$) and the pyrolytic coking term is based on the concentration of coking agent ($c_a$*);

wherein the coking rate ($r_{coking}(z)$) is defined for the coking model as in equation (1)

$$\tau_{coking}(z)=k_c c_a(z)=k_{cat}\varphi_{cat}(z)c_{ethylene}(z),\ z\epsilon[0,L] \quad (1)$$

wherein the surface concentration of catalytically active sites, $C_{cat}$ can change with time due to pyrolytic coke formation, as follows:

$$\frac{d\varphi_{cat}(z)}{dt}=-k_c c_a\cdot(z)\varphi_{cat}(z),\ z\in[0,\ L]\ \ \varphi_{cat}(z)=\left(\frac{c_{cat}}{c_{cat}^{max}}\right), \quad (2)$$

wherein $C_{cat}^{max}$ is the maximum surface concentration of catalytically active sites and with the initial condition:

$\varphi_{cat}(z)=1$, $z\epsilon[0,L]$, $t=0$.

* * * * *